US007012578B2

(12) United States Patent
Nakatsuka et al.

(10) Patent No.: US 7,012,578 B2
(45) Date of Patent: Mar. 14, 2006

(54) LIGHT EMISSION CONTROL DEVICE, BACKLIGHT DEVICE, LIQUID CRYSTAL DISPLAY APPARATUS, LIQUID CRYSTAL MONITOR AND LIQUID CRYSTAL TELEVISION

(75) Inventors: Hiroshi Nakatsuka, Katano (JP); Katsu Takeda, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 370 days.

(21) Appl. No.: 10/454,975

(22) Filed: Jun. 5, 2003

(65) Prior Publication Data

US 2003/0234762 A1 Dec. 25, 2003

(30) Foreign Application Priority Data

Jun. 21, 2002 (JP) ..... 2002-182094

(51) Int. Cl.
*G09G 3/18* (2006.01)

(52) U.S. Cl. ..... 345/52; 323/361

(58) Field of Classification Search ..... 345/52, 345/211; 323/361
See application file for complete search history.

(56) References Cited

U.S. PATENT DOCUMENTS 5,866,969 A * 2/1999 Shimada et al. ..... 310/318
6,075,325 A 6/2000 Kouno et al.

FOREIGN PATENT DOCUMENTS

| | | |
|---|---|---|
| JP | 5-251784 | 9/1993 |
| JP | 8-45679 | 2/1996 |
| JP | 2000-69759 | 3/2000 |
| JP | 3052938 | 4/2000 |

* cited by examiner

*Primary Examiner*—Sumati Lefkowitz
*Assistant Examiner*—Ke Xiao
(74) *Attorney, Agent, or Firm*—Hamre, Schumann, Mueller & Larson, P.C.

(57) ABSTRACT

The present invention provides a light emission control device that can drive a plurality of cold cathode fluorescent tubes independently only by connecting a plurality of piezoelectric transformers to only one piezoelectric inverter circuit. A first phase control portion that outputs a signal for changing a phase of the third and the fourth driving control signals with respect to a phase of the first and the second driving control signals to the second driving portion, and a second phase control portion that outputs a signal for changing a phase of the fifth and the sixth driving control signals with respect to a phase of the first and the second driving control signals to the third driving portion are provided in the piezoelectric inverter circuit. Thus, the phase difference of the driving control signals is controlled, so that the output powers to the plurality of cold cathode fluorescent tubes are controlled.

33 Claims, 21 Drawing Sheets

LIGHT EMISSION CONTROL DEVICE, BACKLIGHT DEVICE, LIQUID CRYSTAL DISPLAY APPARATUS, LIQUID CRYSTAL MONITOR AND LIQUID CRYSTAL TELEVISION

BACKGROUND OF THE INVENTION

1. Field of the Invention

The present invention relates to a technique for driving a cold cathode fluorescent tube employing a piezoelectric transformer for use in backlight devices of liquid crystal panels such as personal computers, liquid crystal monitors, and liquid crystal televisions. In particular, the present invention relates to a light emission device for controlling the driving of a plurality of cold cathode fluorescent tubes with a plurality of piezoelectric transformers.

2. Description of the Related Art

Piezoelectric transformers have the characteristics that when a load is infinite, a very high voltage step-up ratio can be obtained, and when a load becomes smaller, the voltage step-up ratio is decreased. The piezoelectric transformers have advantages such as having higher power density than that of electromagnetic transformers so that compactness can be achieved, being non-combustible, and not generating noise due to electromagnetic induction. From the above-described characteristics, the piezoelectric transformers recently have been used as a power source for a cold cathode fluorescent tube.

FIG. 21 shows the configuration of a Rosen type piezoelectric transformer, which is a typical structure of a conventional piezoelectric transformer. This piezoelectric transformer includes a low impedance portion 1, a high impedance portion 2, input electrodes 3U and 3D, an output electrode 4, and piezoelectric elements 5 and 7. The polarization direction of the piezoelectric element 5 in the low impedance portion 1 is denoted by PD, and the polarization direction of the piezoelectric element 7 in the high impedance portion 2 is denoted by PL.

The low impedance portion 1 of the piezoelectric transformer is an input portion when the transformer is used to step up a voltage. In the low impedance portion 1, polarization is provided in the thickness direction as shown in the polarization direction PD, and the electrodes 3U and 3D are provided on the principal surface and the back thereof, respectively, in the thickness direction. The high impedance portion 2 is an output portion when the transformer is used to step up a voltage. In the high impedance portion 2, polarization is provided in the longitudinal direction as shown in the polarization direction PL, and the electrode 4 is provided in the end face in the longitudinal direction. When a predetermined alternating voltage is applied between the electrodes 3U and 3D, the thus configured piezoelectric transformer excites vibration that expands and contracts in the longitudinal direction and converts this vibration to a voltage generated between the electrodes 3U and 4 by the piezoelectric effect. The voltage is stepped up and down by the impedance conversion with the low impedance portion 1 and the high impedance portion 2.

FIG. 22 shows an equivalent circuit that is approximated with a concentrated constant near the resonant frequency of the piezoelectric transformer shown in FIG. 21. In FIG. 22, Cd1 and Cd2 denote the constraint capacitance on the input side and the output side, respectively; A1 (input side) and A2 (output side) are force factors; m is an equivalent mass; C is an equivalent compliance; and Rm is an equivalent mechanical resistance. In this piezoelectric transformer, the force factor A1 is larger than A2, and in the equivalent circuit shown in FIG. 21, a voltage is stepped up by the two equivalent ideal transformers. Furthermore, since a series resonating portion constituted by the equivalent mass m and the equivalent compliance C is included, the output voltage becomes larger than the transformation ratio of the transformers, especially when a load resistance is large.

For the backlight of a liquid crystal display, in general, a cold cathode fluorescent tube having a cold cathode structure in which a heater is not provided in an electrode for discharge, is used. Since the cold cathode fluorescent tube has the cold cathode structure, the discharge start voltage at which discharge is started and the discharge maintaining voltage at which discharge is maintained are both very high. In a cold cathode fluorescent tube used for a liquid crystal display on the order of 14 inches, in general, 800 Vrms is necessary as the discharge maintaining voltage, and about 1300 Vrms is necessary as the discharge start voltage.

FIG. 23 is a block diagram of a separately-excited oscillation system driving circuit of a conventional piezoelectric transformer. In FIG. 23, reference numeral 13 denotes a variable oscillation circuit for generating an alternating driving signal for driving a piezoelectric transformer 10. An output signal from the variable oscillation circuit 13, which generally has a pulse waveform, is converted to an alternating current signal that is near a sine wave with its high frequency component being removed by a waveform shaping circuit 11. An output signal from the waveform shaping circuit 11 is voltage-amplified to a sufficient level to drive the piezoelectric transformer 10 by a driving circuit 12. The amplified voltage is input to a primary electrode 3U. The voltage input to the primary electrode 3U is stepped up due to the piezoelectric effect of the piezoelectric transformer 10 and is output from a secondary electrode 4.

A high voltage output from the secondary electrode 4 is applied to a series circuit of a cold cathode fluorescent tube 17 and a feedback resistor 18, and an overvoltage protection circuit 20. The overvoltage protection circuit 20 includes voltage dividing resistors 19*a* and 19*b*, and a comparing circuit 15 for comparing a voltage generated across the voltage dividing resistor 19*a* with a first reference voltage Vref1, and controls the variable oscillation circuit 13 via an oscillation control circuit 14 such that the high voltage output from the secondary electrode 4 of the piezoelectric transformer 10 is prevented from becoming higher than the preset voltage determined by the first reference voltage Vref1. The overvoltage protection circuit 20 is not operated while the cold cathode fluorescent tube 17 is turned on.

A feedback voltage generated across the feedback resistor 18 by current flowing the series circuit of the cold cathode fluorescent tube 17 and the feedback resistor 18 is applied to a comparing circuit 16. The comparing circuit 16 compares the feedback voltage with a second reference voltage Vref2 and outputs a signal to the oscillation control circuit 14 so that current flows substantially constantly through the cold cathode fluorescent tube 17. The oscillation control circuit 14 outputs a signal to the variable oscillation circuit 13 so that oscillation occurs at a frequency in accordance with the output signal from the comparing circuit 16. The comparing circuit 16 is not operated before the cold-cathode fluorescent tube 17 is turned on.

Thus, the cold-cathode fluorescent tube 17 is turned on stably. In the case of driving by a separately-excited oscillation system, even if the resonant frequency is changed by the temperature, the driving frequency follows the resonant frequency automatically.

The current flowing through the cold cathode fluorescent tube 17 is controlled so as to be constant by configuring a piezoelectric inverter in this manner.

In recent years, with high brightness of liquid crystal monitors and liquid crystal televisions, brightness required for a liquid crystal backlight is increased. In order to satisfy this demand, not one, but a plurality of cold cathode fluorescent tubes are used.

However, since the light emission control device outputs an input dc voltage as a high-voltage ac voltage, utilizing the resonance operation of the piezoelectric transformer, the following problem is caused in the case where the cold cathode fluorescent tube is connected in the manner as shown in FIG. 23. When one cold cathode fluorescent tube is turned on, the inverter output voltage is reduced, and therefore other cold cathode fluorescent tubes cannot be turned on.

In order to solve this problem, it is necessary to drive a plurality of piezoelectric transformers. However, in the conventional light emission control device shown in FIG. 23, a plurality of piezoelectric inverter circuits have to be provided in order to turn a plurality of cold cathode fluorescent tubes on simultaneously, which results in a complicated and large-scale circuitry.

For the purpose of solving this problem, JP 5-251784A discloses a thickness longitudinal vibration piezoelectric ceramic transformer for driving a plurality of loads, using a piezoelectric inverter circuit employing a piezoelectric transformer, and a method for producing the same. This publication describes that according to this thickness longitudinal vibration piezoelectric ceramic transformer and the method for producing the same, compactness, high efficiency, and multi-input and multi-output can be achieved.

For the purpose of solving the above-described problem, JP 8-45679A discloses a lighting device for a cold cathode fluorescent tube for driving a plurality of loads, using a piezoelectric inverter circuit employing a piezoelectric transformer. This publication describes that according to this lighting device for a cold cathode fluorescent tube, a lighting device for a cold cathode fluorescent tube that can turn on a plurality of cold cathode fluorescent tubes by a high voltage with a high frequency from one piezoelectric transformer can be provided.

According to this thickness longitudinal vibration piezoelectric ceramic transformer and the method for producing the same disclosed in JP 5-251784A, it is true that a plurality of loads can be driven by using this piezoelectric transformer. However, different voltages are applied to the plurality of loads each other, because of the relationship between the output impedance of the piezoelectric transformer and the load impedance. Therefore, it is impossible to control a plurality of loads independently by the driving control of the piezoelectric transformer, only with one piezoelectric inverter circuit.

Also with the lighting device for a cold cathode fluorescent tube disclosed in JP 8-45679A, it is possible to drive a plurality of cold cathode fluorescent tubes simultaneously by the piezoelectric transformer. However, in this driving method, the output voltage from the piezoelectric transformer becomes high, and when considering the space distance and the creeping distance with respect to the high voltage, it is unlikely that compactness of the device can be achieved. In addition, in the safety design, it is not preferable that a voltage of several thousands of volts is output constantly in the inside of the apparatus. Furthermore, since the cold cathode fluorescent tubes are connected in series, so that with only one piezoelectric inverter circuit, a plurality of cold cathode fluorescent tubes cannot be controlled independently.

SUMMARY OF THE INVENTION

Therefore, with the foregoing in mind, it is an object of the present invention to provide a light emission control device that can drive a plurality of cold cathode fluorescent tubes independently, simply by connecting a plurality of piezoelectric transformers to only one piezoelectric inverter circuit, and to provide a backlight device for illuminating an object to be illuminated from its back with such a light emission control device, a liquid crystal display apparatus for illuminating a liquid crystal panel with such a backlight device, and a liquid crystal monitor and a liquid crystal television using such a liquid crystal display apparatus.

In order to achieve the above object, a first light emission control device of the present invention includes a plurality of serially-connected elements in each of which two switching means are connected in series between a power potential and a ground potential, including a first serially-connected element, and a plurality of second serially-connected elements, each of which includes an inductor and a pair of input electrodes of a piezoelectric transformer, and is connected between a connection point of the switching means of the first serially-connected element and a connection point of the switching means of another serially-connected element; and a plurality of cold cathode fluorescent tubes, each of which is connected to an output electrode of the piezoelectric transformer at one end.

In order to achieve the above object, a second light emission control device of the present invention includes a first serially-connected element connected between a power potential and a ground potential, including first switching means and second switching means that are turned on/off alternately in response to a first driving control signal (S1) and a second driving control signal (S2), respectively; a second serially-connected element connected in parallel to the first serially-connected element, including third switching means and fourth switching means that are turned on/off alternately in response to a third driving control signal (S3) and a fourth driving control signal (S4), respectively, the third and the fourth driving control signals having the same frequency and duty ratio as those of the first and the second driving control signals; a third serially-connected element connected in parallel to the first serially-connected element, including fifth switching means and sixth switching means that are turned on/off alternately in response to a fifth driving control signal (S5) and a sixth driving control signal (S6), respectively, the fifth and the sixth driving control signals having the same frequency and duty ratio as those of the first and the second driving control signals; a first piezoelectric transformer and a second piezoelectric transformer that step up or down a voltage input from a primary electrode by a piezoelectric effect and outputs the voltage from a secondary electrode; a fourth serially-connected element connected between a connection point of the first switching means and the second switching means and a connection point of the third switching means and the fourth switching means, including a first inductor and a pair of primary electrodes of the first piezoelectric transformer; a fifth serially-connected element connected between a connection point of the first switching means and the second switching means and a connection point of the fifth switching means and the sixth switching means, including a second inductor and a pair of primary electrodes of the second piezoelectric transformer;

a sixth serially-connected element connected between a secondary electrode of the first piezoelectric transformer and a ground potential, including a first cold cathode fluorescent tube and a first current detection resistor; a seventh serially-connected element connected between a secondary electrode of the second piezoelectric transformer and a ground potential, including a second cold cathode fluorescent tube and a second current detection resistor; first driving means (a first driving portion) that generates the first and the second driving control signals; second driving means (a second driving portion) that generates the third and the fourth driving control signals; third driving means (a third driving portion) that generates the fifth and the sixth driving control signals; first feedback means (a first feedback portion) that rectifies an alternating voltage detected by the first current detection resistor and feeds back the voltage as a first detected voltage; second feedback means (a second feedback portion) that rectifies an alternating voltage detected by the second current detection resistor and feeds back the voltage as a second detected voltage; first comparing means (a first comparing portion) that compares the first detected voltage output from the first feedback portion with a first reference voltage (Vref1) and outputs a first error signal; second comparing means (a second comparing portion) that compares the second detected voltage output from the second feedback means with a second reference voltage (Vref2) and outputs a second error signal; first phase control means (a first phase control portion) that outputs a signal for changing a phase of the third and the fourth driving control signals with respect to a phase of the first and the second driving control signals in accordance with the first error signal to the second driving means; and second phase control means (a second phase control portion) that outputs a signal for changing a phase of the fifth and the sixth driving control signals with respect to a phase of the first and the second driving control signals in accordance with the second error signal to the third driving means.

In order to achieve the above object, a third light emission control device of the present invention includes a first serially-connected element connected between a power potential and a ground potential, including first switching means and second switching means that are turned on/off alternately in response to a first driving control signal (S1) and a second driving control signal (S2), respectively; a second serially-connected element connected in parallel to the first serially-connected element, including third switching means and fourth switching means that are turned on/off alternately in response to a third driving control signal (S3) and a fourth driving control signal (S4), respectively, the third and the fourth driving control signals having the same frequency and duty ratio as those of the first and the second driving control signals; a third serially-connected element connected in parallel to the first serially-connected element, including fifth switching means and sixth switching means that are turned on/off alternately in response to a fifth driving control signal (S5) and a sixth driving control signal (S6), respectively, the fifth and the sixth driving control signals having the same frequency and duty ratio as those of the first and the second driving control signals; a first piezoelectric transformer and a second piezoelectric transformer that step up or down a voltage input from a primary electrode by a piezoelectric effect and outputs the voltage from a secondary electrode; a fourth serially-connected element connected between a connection point of the first switching means and the second switching means and a connection point of the third switching means and the fourth switching means, including a first inductor and a pair of primary electrodes of the first piezoelectric transformer; a fifth serially-connected element connected between a connection point of the first switching means and the second switching means and a connection point of the fifth switching means and the sixth switching means, including a second inductor and a pair of primary electrodes of the second piezoelectric transformer; a sixth serially-connected element connected between a secondary electrode of the first piezoelectric transformer and a ground potential, including a first cold cathode fluorescent tube and a first current detection resistor; a seventh serially-connected element connected between a secondary electrode of the second piezoelectric transformer and a ground potential, including a second cold cathode fluorescent tube and a second current detection resistor; first driving means (a first driving portion) that generates the first and the second driving control signals; second driving means (a second driving portion) that generates the third and the fourth driving control signals; third driving means (a third driving portion) that generates the fifth and the sixth driving control signals; first feedback means (a first feedback portion) that rectifies an alternating voltage detected by the first current detection resistor and feeds back the voltage as a first detected voltage; second feedback means (a second feedback portion) that rectifies an alternating voltage detected by the second current detection resistor and feeds back the voltage as a second detected voltage; A/D converting means (A/D) that converts analog values of the first and the second detected voltages output from the first and the second feedback means to digital values of first and second detection data; first comparing means (a first comparing portion) that compares the first detection data output from the A/D converting means with first reference data (Vref1') and outputs first error data; second comparing means (a second comparing portion) that compares the second detection data output from the A/D converting means with second reference data (Vref2') and outputs second error data; first phase control means (a first phase control portion) that generates first phase control data for changing a phase of the third and the fourth driving control signals with respect to a phase of the first and the second driving control signals in accordance with the first error data; second phase control means (a second phase control portion) that generates second phase control data for changing a phase of the fifth and the sixth driving control signals with respect to a phase of the first and the second driving control signals in accordance with the second error data; and D/A converting means (D/A) that converts the first and the second phase control data to analog values and outputs the analog values to the second and the third driving means, respectively.

In order to achieve the above object, a fourth light emission control device of the present invention includes a first serially-connected element connected between a power potential and a ground potential, including first switching means and second switching means that are turned on/off alternately in response to a first driving control signal (S1) and a second driving control signal (S2), respectively; a second serially-connected element connected in parallel to the first serially-connected element, including third switching means and fourth switching means that are turned on/off alternately in response to a third driving control (S3) signal and a fourth driving control signal (S4), respectively, the third and the fourth driving control signals having the same frequency and duty ratio as those of the first and the second driving control signals; a third serially-connected element connected in parallel to the first serially-connected element, including fifth switching means and sixth switching means that are turned on/off alternately in response to a fifth driving control signal (S5) and a sixth driving control signal (S6), respectively, the fifth and the sixth driving control signals having the same frequency and duty ratio as those of the first and the second driving control signals; a first piezoelectric transformer and a second piezoelectric transformer that step up or down a voltage input from a primary electrode by a piezoelectric effect and output a voltage having a 180 degree different phase from each other from a pair of secondary electrodes; a fourth serially-connected element connected between a connection point of the first switching means and the second switching means and a connection point of the third switching means and the fourth switching means, including a first inductor and a pair of primary electrodes of the first piezoelectric transformer; a fifth serially-connected element connected between a connection point of the first switching means and the second switching means and a connection point of the fifth switching means and the sixth switching means, including a second inductor and a pair of primary electrodes of the second piezoelectric transformer; a sixth serially-connected element connected between a pair of secondary electrodes of the first piezoelectric transformer, including a first cold cathode fluorescent tube group including a plurality of cold cathode fluorescent tubes and a first current detecting portion disposed between the plurality of cold cathode fluorescent tubes constituting the first cold cathode fluorescent tube group; a seventh serially-connected element connected between a pair of secondary electrodes of the second piezoelectric transformer, including a second cold cathode fluorescent tube group including a plurality of cold cathode fluorescent tubes and a second current detecting portion disposed between the plurality of cold cathode fluorescent tubes constituting the second cold cathode fluorescent tube group; first driving means (a first driving portion) that generates the first and the second driving control signals; second driving means (a second driving portion) that generates the third and the fourth driving control signals; third driving means (a third driving portion) that generates the fifth and the sixth driving control signals; first feedback means (a first feedback portion) that rectifies an alternating voltage detected by the first current detecting portion and feeds back the voltage as a first detected voltage; second feedback means (a second feedback portion) that rectifies an alternating voltage detected by the second current detecting portion and feeds back the voltage as a second detected voltage; first comparing means (a first comparing portion) that compares the first detected voltage output from the first feedback portion with a first reference voltage (Vref1) and outputs a first error signal; second comparing means (a second comparing portion) that compares the second detected voltage output from the second feedback portion with a second reference voltage (Vref2) and outputs a second error signal; first phase control means (a first phase control portion) that outputs a signal for changing a phase of the third and the fourth driving control signals with respect to a phase of the first and the second driving control signals in accordance with the first error signal to the second driving portion; and second phase control means (a second phase control portion) that outputs a signal for changing a phase of the fifth and the sixth driving control signals with respect to a phase of the first and the second driving control signals in accordance with the second error signal to the third driving portion.

In the first to the fourth light emission control devices, it is preferable that the cold cathode fluorescent tube is turned on or off by setting switching timings of the plurality of serially-connected elements, each of which includes two switching means, to be the same as a switching timing of the first serially-connected element.

In the first to the fourth light emission control devices, it is preferable that driving frequencies of a plurality of piezoelectric transformers are set to a frequency higher than a highest resonant frequency of the plurality of piezoelectric transformers.

In the third light emission control device, it is preferable that the A/D converting means, the first and the second comparing means, the first and the second phase control means and the D/A converting means are included in a microcomputer.

In the first to the third light emission control devices, it is preferable that the plurality of cold cathode fluorescent tubes are controlled individually with respect to brightness. In this case, it is preferable that the brightness is controlled by turning on or off the plurality of cold cathode fluorescent tubes individually.

In the fourth light emission control device, it is preferable that the first cold cathode fluorescent tube group and the second cold cathode fluorescent tube group are controlled individually with respect to brightness. In this case, it is preferable that the brightness is controlled by turning on or off the first cold cathode fluorescent tube group and the second cold cathode fluorescent tube group individually.

In order to achieve the above object, a backlight device of the present invention is characterized by being configured such that an object to be illuminated is illuminated from its back by any one of the first to the fourth light emission control devices.

In order to achieve the above object, a liquid crystal display apparatus of the present invention is characterized by being configured such that a liquid panel is illuminated by the backlight device of the present invention.

In order to achieve the above object, a liquid crystal monitor of the present invention is characterized by using the liquid crystal display apparatus of the present invention.

In order to achieve the above object, a liquid crystal television of the present invention is characterized by using the liquid crystal display apparatus of the present invention.

According to the above configuration, a light emission control device that can drive a plurality of cold cathode fluorescent tubes simply by connecting a plurality of piezoelectric transformers to only one driving circuit is achieved. In addition, a backlight device that illuminates an object to be illuminated from its back with such a light emission control device, a liquid crystal display apparatus that illuminates a liquid crystal panel with such a backlight device, and a liquid crystal monitor and a liquid crystal television using such a liquid crystal display apparatus, are achieved.

BRIEF DESCRIPTION OF THE DRAWINGS

FIG. 6 is a graph showing the frequency characteristics of the voltage step-up ratio of the piezoelectric transformer before and after the cold cathode fluorescent tube is turned on.

DESCRIPTION OF THE PREFERRED EMBODIMENTS

Hereinafter, preferable embodiments of the present invention will be described with reference to the accompanying drawings.

First Embodiment

Figure 1:
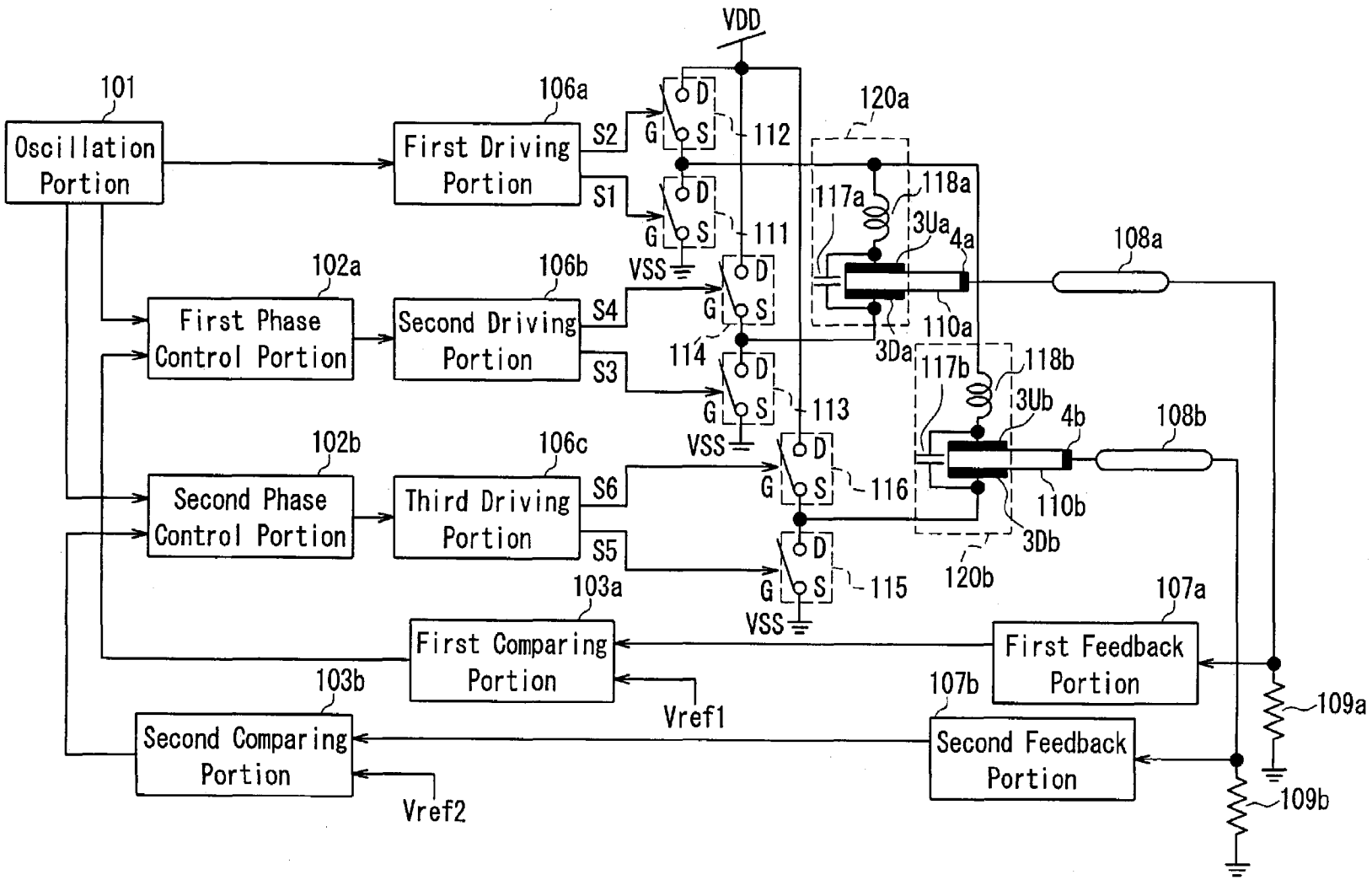
FIG. 1 is a block diagram showing an example of the structure of a light emission control device according to a first embodiment of the present invention.

FIG. 1 is a block diagram showing an example of the structure of a light emission control device according to a first embodiment of the present invention. The structure of the piezoelectric transformer used in this embodiment is the same as that of the conventional example shown in FIG. 21, and the operation thereof also is the same.

Referring to FIG. 1, an oscillation portion 101 generates an alternating driving signal that drives a first piezoelectric transformer 110*a* and a second piezoelectric transformer 110*b*. Three output signals from the oscillation portion 101 are input to a first driving portion 106*a* directly, a second driving portion 106*b* via a first phase control portion 102*a*, and a third driving portion 106*c* via a second phase control portion 102*b*. The first phase control portion 102*a* and the second phase control portion 102*b* output alternating signals having the same frequency as and a different phase from that of the alternating signal input to the first driving portion 106*a* to the second driving portion 106*b* and the third driving portion 106*c* in accordance with the output signals from a first comparing portion 103*a* and a second comparing portion 103*b*, respectively.

The first driving portion 106*a* outputs driving control signals S1 and S2 to the gate terminals (G) of two N channel MOSFETs 111 and 112, which are switching means, respectively. The second driving portion 106*b* outputs driving control signals S3 and S4 to the gate terminals (G) of two N channel MOSFETs 113 and 114, which are switching means, respectively. The third driving portion 106*c* outputs driving control signals S5 and S6 to the gate terminals (G) of two N channel MOSFETs 115 and 116, which are switching means, respectively.

A first serially-connected element in which the source terminal (S) of the N channel MOSFET 112 is connected to the drain terminal (D) of the N channel MOSFET 111 and a second serially-connected element in which the source terminal (S) of the N channel MOSFET 114 is connected to the drain terminal (D) of the N channel MOSFET 113 are connected between the power potential VDD and the ground potential VSS so as to configure a first full-bridge. In addition, the first serially-connected element and a third serially-connected element in which the source terminal (S)

of the N channel MOSFET 116 is connected to the drain terminal (D) of the N channel MOSFET 115 are connected between the power potential VDD and the ground potential VSS so as to configure a second full-bridge.

A fourth serially-connected element in which a first inductor 118*a* is connected in series to a first capacitor 117*a* that is connected in parallel to the input electrodes 3Ua and 3Da of the first piezoelectric transformer 110*a* is connected between the connection point between the N channel MOSFETs 111 and 112 constituting the first serially-connected element and the connection point between the N channel MOSFETs 113 and 114 constituting the second serially-connected element. The first inductor 118*a,* the first capacitor 117*a* and the input capacitor of the first piezoelectric transformer 110*a* constitute a first resonance portion 120*a.*

A fifth serially-connected element in which a second inductor 118*b* is connected to a second capacitor 117*b* that is connected in parallel to the input electrodes 3Ub and 3Db of the second piezoelectric transformer 110*b* is connected between the connection point between the N channel MOSFETs 111 and 112 constituting the first serially-connected element and the connection point between the N channel MOSFETs 115 and 116 constituting the third serially-connected element. The second inductor 118*b,* the second capacitor 117*b* and the input capacitor of the second piezoelectric transformer 110*b* constitute a second resonance portion 120*b.*

The voltage input to the primary electrodes 3Ua and 3Da of the first piezoelectric transformer 110*a* is stepped up by the piezoelectric effect and is output from the secondary electrode 4*a* as a high voltage. The voltage input to the primary electrodes 3Ub and 3Db of the second piezoelectric transformer 110*b* is stepped up by the piezoelectric effect and is output from the secondary electrode 4*b* as a high voltage.

The high voltage output from the secondary electrode 4*a* of the first piezoelectric transformer 110*a* is applied to a sixth serially-connected element in which a first cold cathode fluorescent tube 108*a* is connected to a first current detection resistor 109*a*. The high voltage output from the secondary electrode 4*b* of the second piezoelectric transformer 110*b* is applied to a seventh serially-connected element in which a second cold cathode fluorescent tube 108*b* is connected to a second current detection resistor 109*b*.

An alternating voltage detected by the first current detection resistor 109*a* is rectified by a first feedback portion 107*a* and is input to a first comparing portion 103*a*. An alternating voltage detected by the second current detection resistor 109*b* is rectified by a second feedback portion 107*b* and is input to a second comparing portion 103*b*.

The first comparing portion 103*a* compares the detected voltage from the first feedback portion 107*a* with a first reference voltage Vref1. When the detected voltage is larger than the first reference voltage Vref1, the first comparing portion 103*a* outputs a control signal to the first phase control portion 102*a* so that the input power to the first piezoelectric transformer 110*a* becomes small. When the detected voltage is smaller than the first reference voltage Vref1, the first comparing portion 103*a* outputs a control signal to the first phase control portion 102*a* so that the input power to the first piezoelectric transformer 110*a* becomes large. The first phase control portion 102*a* supplies a signal to the second driving portion 106*b* in accordance with the output signal from the first comparing portion 103*a* so as to control the input power to the first piezoelectric transformer 110*a*.

Similarly, the second comparing portion 103*b* compares the detected voltage from the second feedback portion 107*b* with a second reference voltage Vref2. When the detected voltage is larger than the second reference voltage Vref2, the second comparing portion 103*b* outputs a control signal to the second phase control portion 102*b* so that the input power to the second piezoelectric transformer 110*b* becomes small. When the detected voltage is smaller than the second reference voltage Vref2, the second comparing portion 103*b* outputs a control signal to the second phase control portion 102*b* so that the input power to the second piezoelectric transformer 110*b* becomes large. The second phase control portion 102*b* supplies a signal to the third driving portion 106*c* in accordance with the output signal from the second comparing portion 103*b* so as to control the input power to the second piezoelectric transformer 110*b*.

Figure 2:
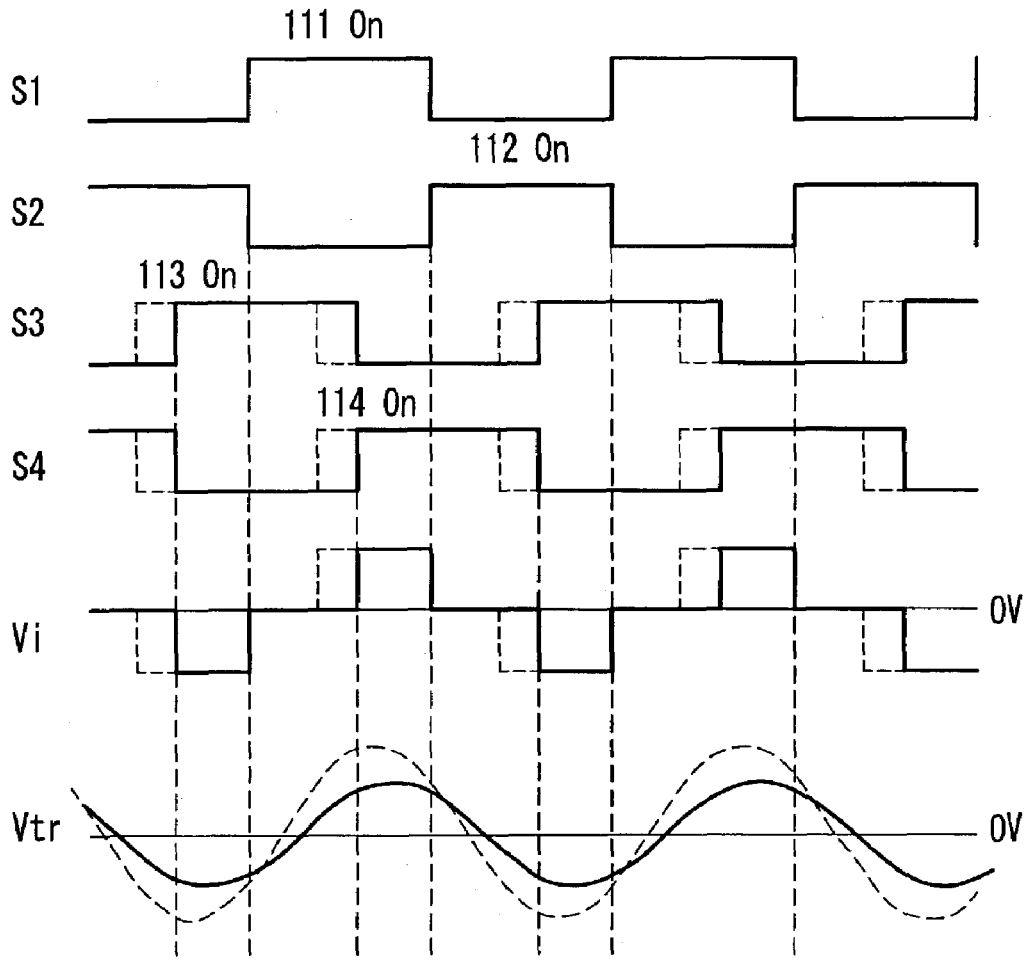
FIG. 2 is a timing chart of signals of each portion for illustrating the operation of the first full-bridge shown in FIG. 1.
Figure 3:
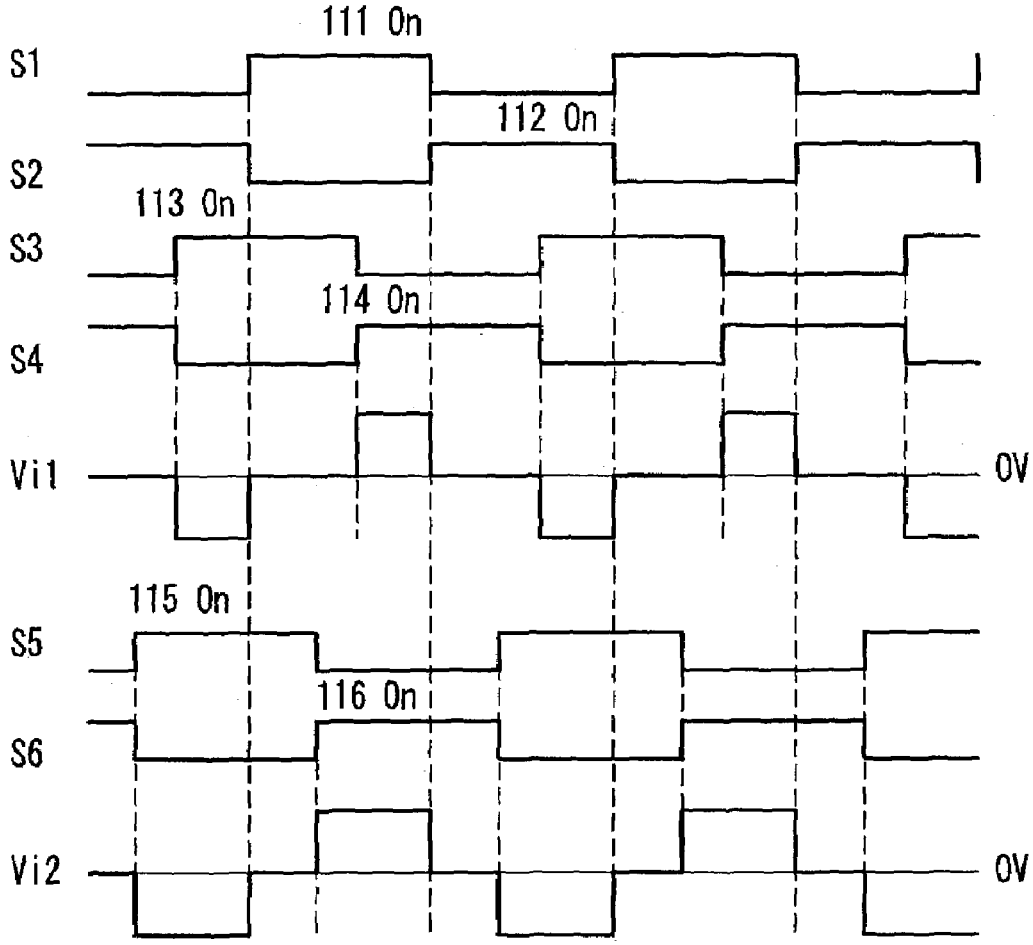
FIG. 3 is a timing chart of signals of each portion for illustrating the operation of the first and the second full-bridges shown in FIG. 1.

Next, the operation of the light emission control device as configured as above will be described with reference to FIGS. 2 and 3, in addition to FIG. 1. FIG. 2 is a timing chart of signals of each portion for illustrating the operation of the first full-bridge constituted by the N channel MOS transistors 111, 112, 113, and 114. FIG. 3 is a timing chart of signals of each portion for illustrating the operation of the first full-bridge constituted by the N channel MOS transistors 111, 112, 113, and 114 and the second full-bridge constituted by the N channel MOS transistors 111, 112, 115, and 116.

In FIG. 2, Vi denotes an input voltage to the resonance portion 120*a,* and Vtr denotes a voltage across the primary electrodes 3Ua and 3Da of the first piezoelectric transformer 110*a*. The driving control signals S1 and S2 are set so as to be turned on/off alternately at a predetermined on-time ratio, and the driving control signals S3 and S4 are set so as to be turned on/off alternately at the same on-time ratio as that of the driving control signals S1 and S2 and with a phase difference.

The solid lines of the driving control signals S3 and S4 show the waveforms when the brightness of the cold cathode fluorescent tube 108*a* is low or when the input voltage to the first piezoelectric transformer 110*a* is high. In this case, the input power to the first piezoelectric transformer 110*a* is controlled so as to be small by decreasing the phase difference between the driving control signals S1 and S2 and the driving control signals S3 and S4. The broken lines of the driving control signals S3 and S4 show the waveforms when the brightness of the cold cathode fluorescent tube 108*a* is high or when the input voltage to the first piezoelectric transformer 110*a* is low. In this case, the input power to the first piezoelectric transformer 110*a* is controlled so as to be large by increasing the phase difference between the driving control signals S1 and S2 and the driving control signals S3 and S4.

The voltage Vi is applied to the first resonance portion 120*a* by performing the phase difference control of the on/off of the N channel MOSFETs 111, 112, 113, and 114 in this manner. The solid line of the voltage Vi shows the waveform at the timing at which the driving control signals S3 and S4 are shown by the solid line, and the broken line of the voltage Vi shows the waveform at the timing at which the driving control signals S3 and S4 are shown by the broken line.

The switching frequencies of the driving control signals S1, S2, S3, and S4 are set to a frequency near the resonant frequency fr of the first resonance portion 120*a,* so that the input voltage Vtr to the first piezoelectric transformer 110*a* has a sine waveform. The solid line of the voltage Vtr shows the waveform at the timing at which the voltage Vi is shown by the solid line, and the broken line of the voltage Vtr shows the waveform at the timing at which the voltage Vi is shown by the broken line.

The resonant frequency fr of the first resonance portion 120*a* can be expressed by Equation (1) below, where L is the inductance of the first inductor 118*a,* and Cp is the input capacitance of the first piezoelectric transformer 110*a* and C is the capacitance of the first capacitor 117*a. Equation* 1

$$fr=1/(2\pi\sqrt{LmedCp+Cmed})\quad(1)$$

The input power to the first piezoelectric transformer 110*a* can be controlled with a single frequency by performing the driving in this manner.

In FIG. 3, Vi1 shows the input voltage to the first resonance portion 120*a,* and Vi2 shows the input voltage to the second resonance portion 120*b.* The operation in FIG. 3 is the same as that described with reference to FIG. 2. In the same manner as in the operation in FIG. 2, the input power to the second piezoelectric transformer 110*b,* in addition to the input power to the first piezoelectric transformer 110*a,* can be controlled with a single frequency by controlling the phase difference between the driving control signals S1 and S2 and the driving control signals S5 and S6, in addition to controlling the phase difference between the driving control signals S1 and S2 and the driving control signals S3 and S4.

As described above, according to this embodiment, each power control can be performed individually even if a plurality of piezoelectric transformers 110*a* and 110*b* are provided in order to turn on a plurality of cold cathode fluorescent tubes 108*a* and 108*b*. As a result, compactness by reducing the number of circuit components and high efficiency operation near the resonant frequency can be achieved.

Figure 4:
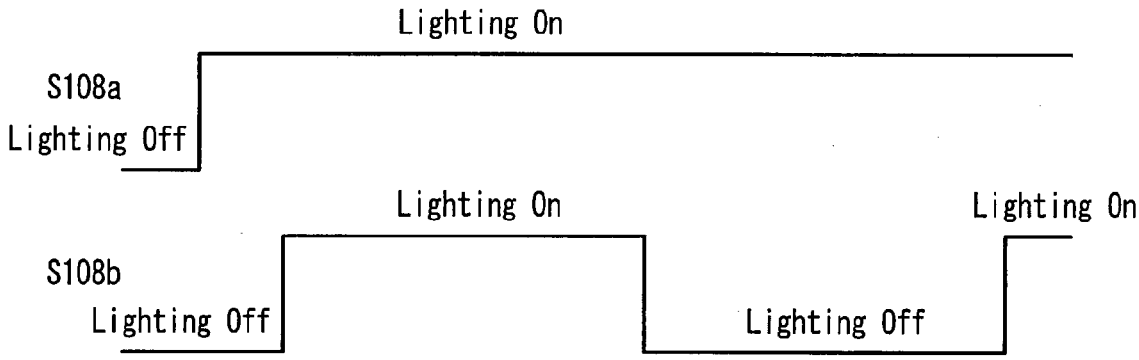
FIG. 4 is a diagram for illustrating the control of the plurality of cold cathode fluorescent tubes shown in FIG. 1 individually so as to be turned on and off.

Furthermore, only one of the cold cathode fluorescent tubes can be turned off by setting the phase difference between the driving control signals S1 and S2 and the driving control signals S3 and S4 or the phase difference between the driving control signals S1 and S2 and the driving control signals S5 and S6 to zero. The control in this manner makes it possible to perform individual control of a plurality of cold cathode fluorescent tubes while they are turned on, as shown in FIG. 4 (S108*a* shows the state of the cold cathode fluorescent tube 108*a,* and S108*b* shows the state of the cold cathode fluorescent tube 108*b*).

Furthermore, it is possible to control the brightness of each of the cold cathode fluorescent tubes 108*a* and 108*b* individually by making the first reference voltage Vref1 and the second reference voltage Vref2 different.

Figure 21:
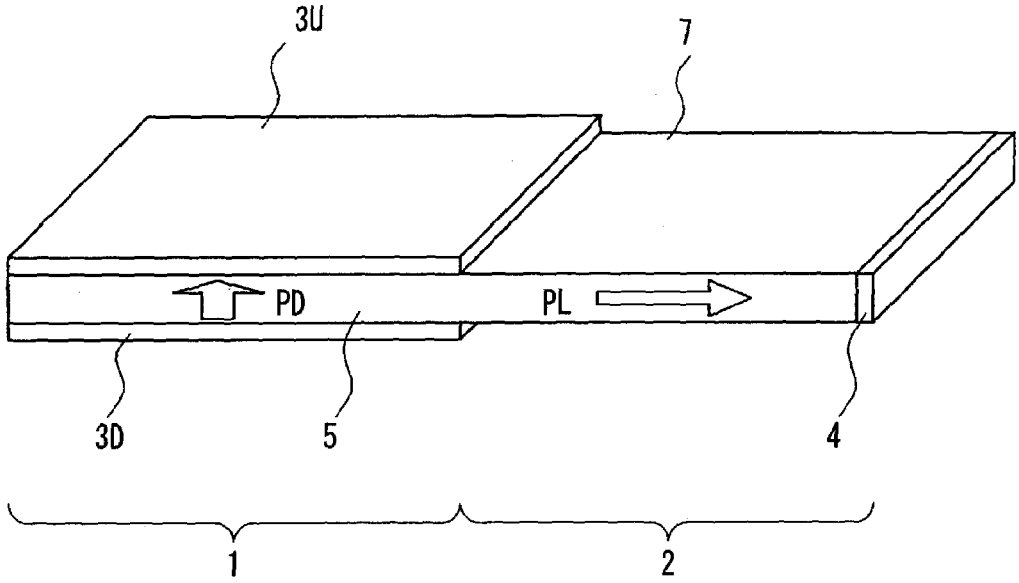
FIG. 21 PRIOR ART
FIG. 21 is a perspective view showing the schematic structure of a conventional Rosen type piezoelectric transformer.
Figure 22:
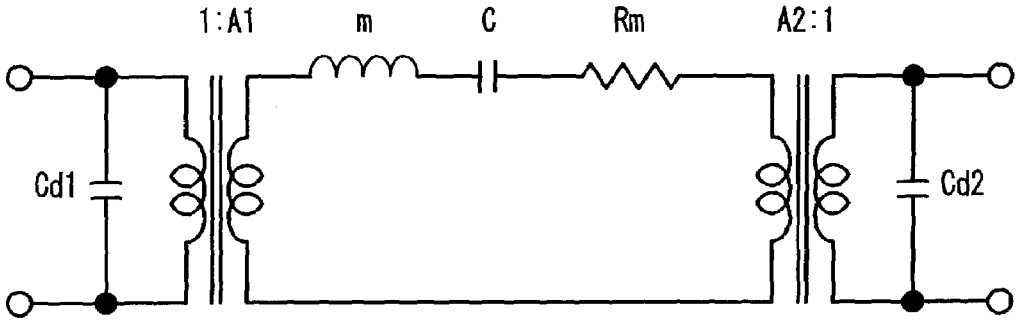
FIG. 22 PRIOR ART
FIG. 22 is an equivalent circuit diagram near the resonant frequency of the Rosen type piezoelectric transformer shown in FIG. 21.
Figure 23:
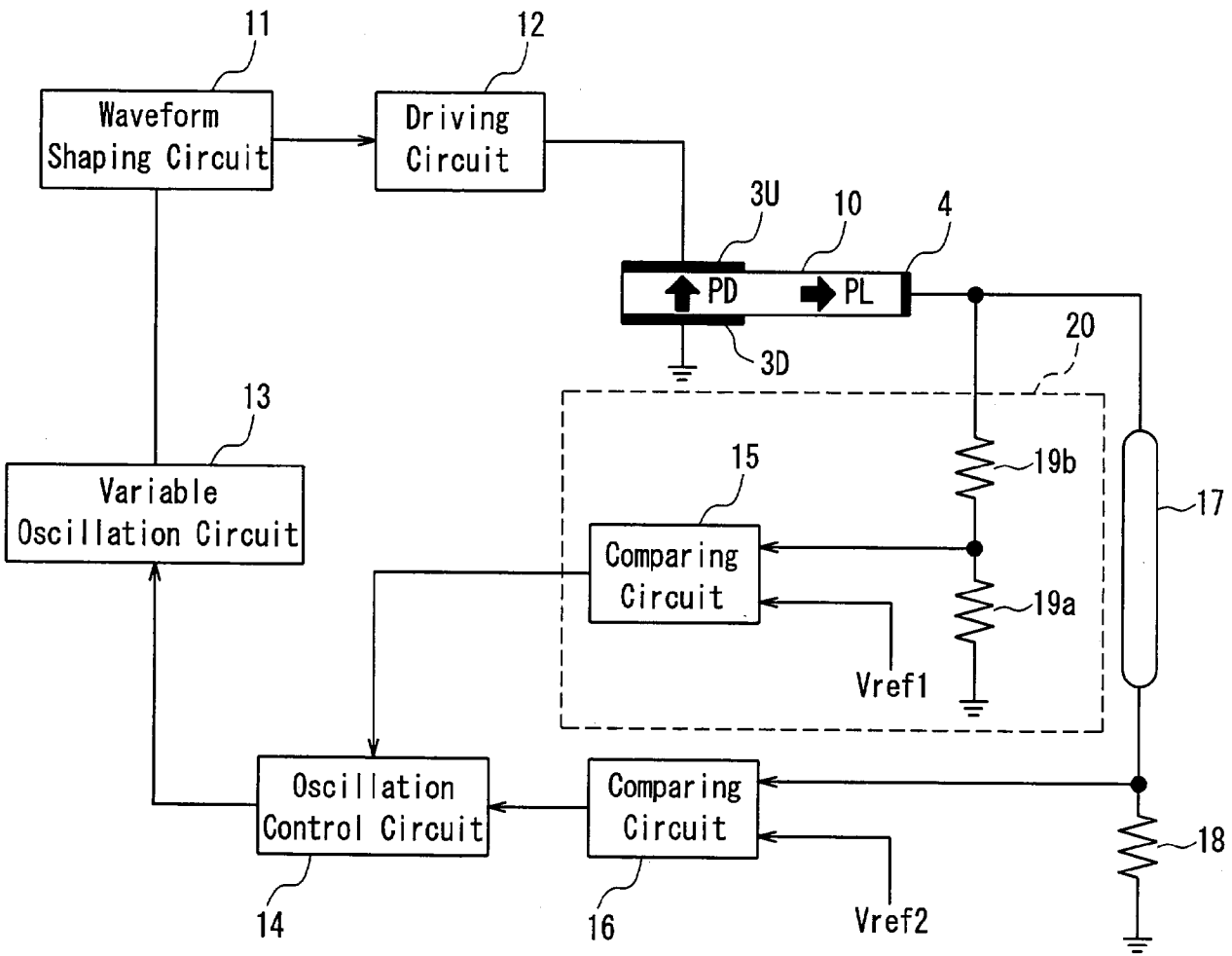
FIG. 23 PRIOR ART
FIG. 23 is a block diagram showing an example of the structure of a conventional light emission control device.

In this embodiment, the piezoelectric transformer having the conventional structure shown in FIG. 21 is used. However, the same effect can be obtained with piezoelectric transformers having other structures, as long as they step up or down a voltage input from the primary side by the piezoelectric effect and output the voltage from the secondary side.

In this embodiment, the cold cathode fluorescent tube is used as the load of the piezoelectric transformer. However, the same effect can be obtained by using the light emission control device and the control method described in this embodiment, even if a load in which the impedance is not varied such as a resistance load is used.

Second Embodiment

Figure 5:
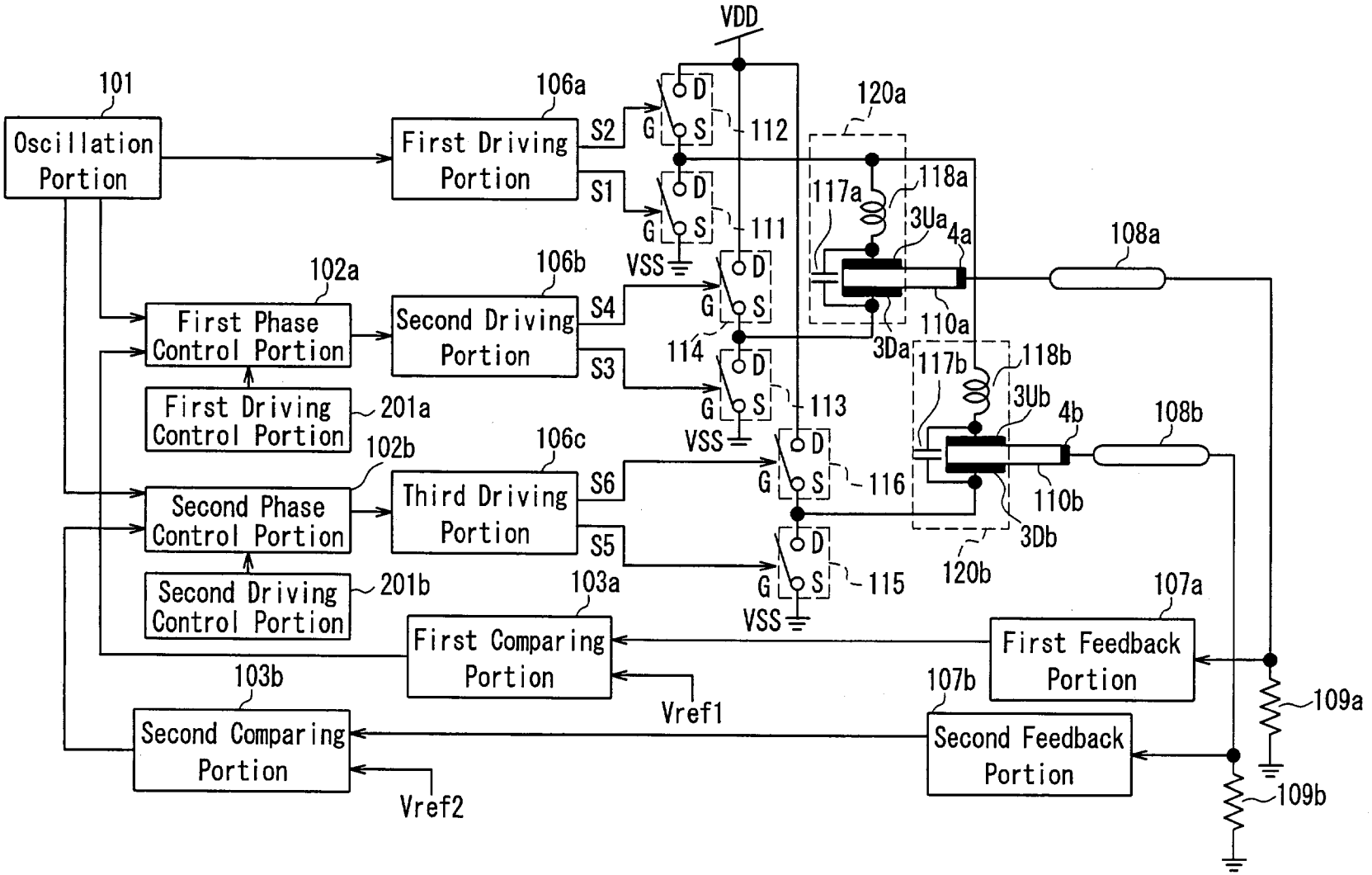
FIG. 5 is a block diagram showing an example of the structure of a light emission control device according to a second embodiment of the present invention.

FIG. 5 is a block diagram showing an example of the structure of a light emission control device according to a second embodiment of the present invention.

This embodiment is different from the first embodiment in that a first driving control portion 201*a* corresponding to the first phase control portion 102*a* and a second driving control portion 201*b* corresponding to the second phase control portion 102*b* are provided. This embodiment is the same as the first embodiment in other structural and operation aspects.

Hereinafter, the operations of the first driving control portion 201*a* and the second driving control portion 201*b* will be described with reference to FIGS. 6 and 7.

Figure 6:
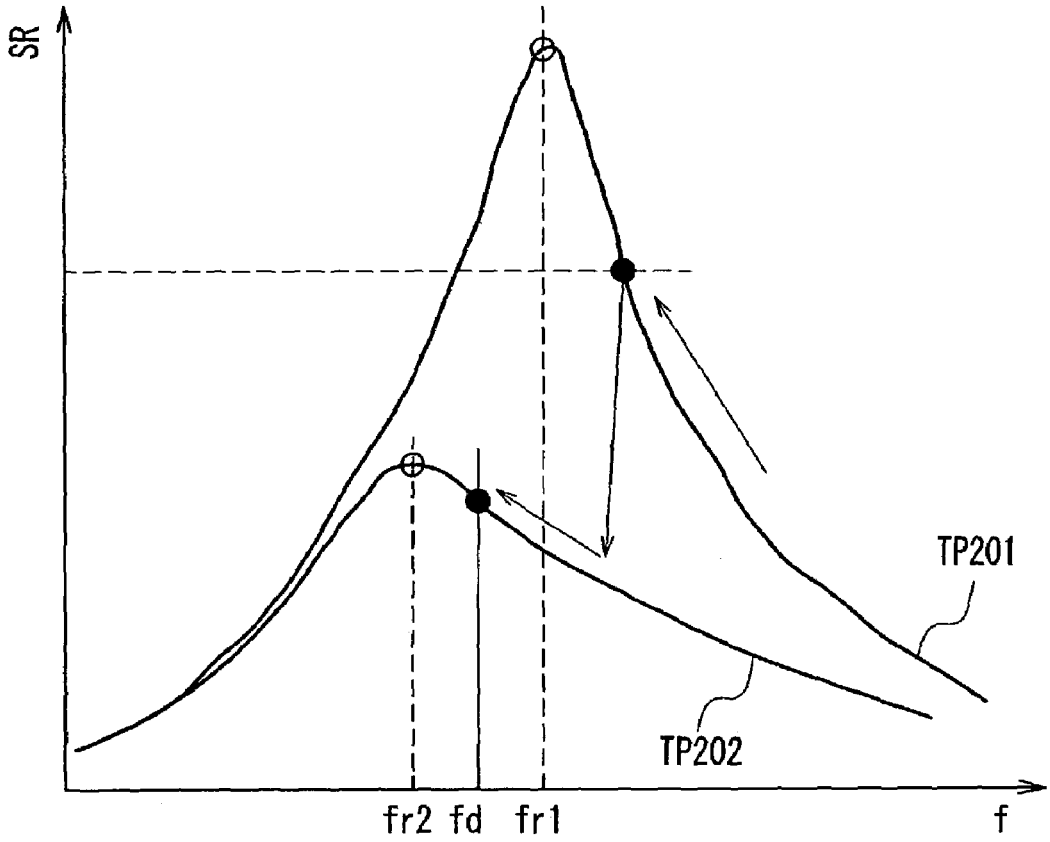

FIG. 6 is a graph showing the frequency characteristics of the voltage step-up ratio SR of the piezoelectric transformer at the start of the operation and during the steady operation of the cold cathode fluorescent tube. In FIG. 6, the voltage step-up ratio SR is at the maximum value at a resonant frequency fr1, as shown in a curve TP201, before the cold cathode fluorescent tube is turned on. During the operation, the voltage step-up ratio SR is at the maximum value at a resonant frequency fr2, as shown in a curve TP202. In the graph, fd is a driving frequency of the piezoelectric transformer during the steady operation of the cold cathode fluorescent tube.

Figure 7:
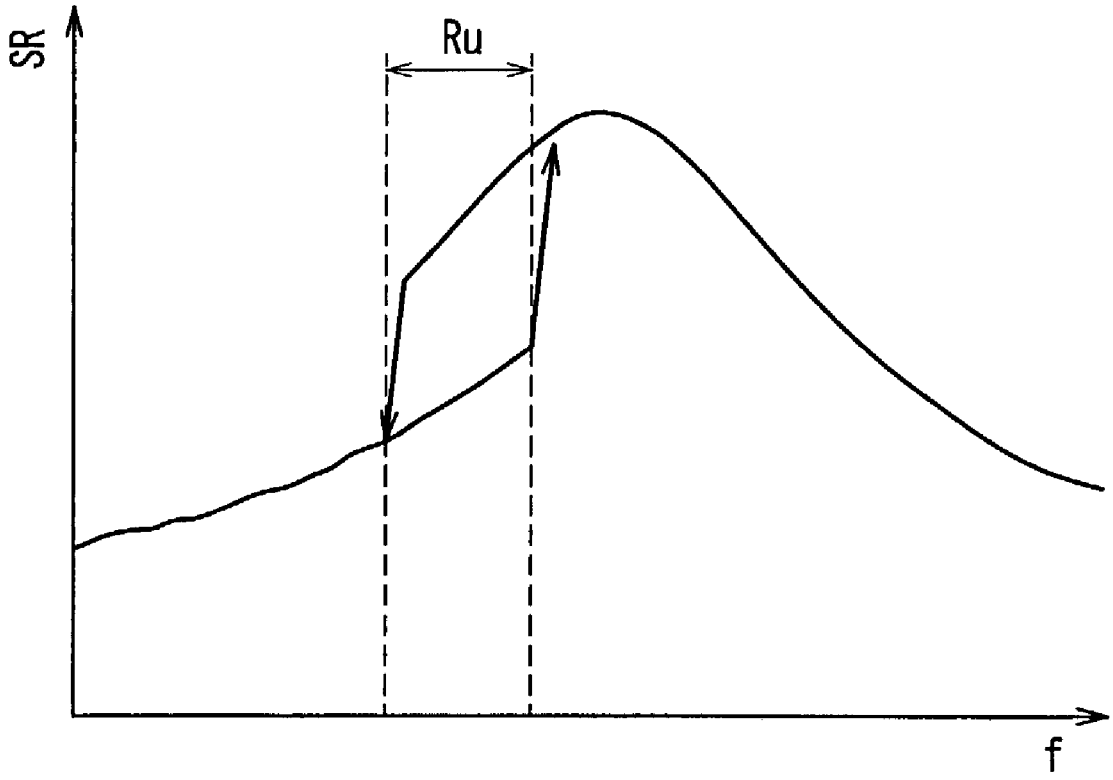
FIG. 7 is a graph for illustrating the nonlinear phenomenon of the piezoelectric transformer.

FIG. 7 is a graph for illustrating the nonlinearity of the voltage step-up ratio SR of the piezoelectric transformer. The piezoelectric transformer exhibits a jump phenomenon at a frequency lower than the frequency at which the voltage step-up ratio SR is at the maximum value when it is operated at a large amplitude. In this case, as shown in FIG. 7, there is an unstable region Ru in which the characteristics are changed between when the frequency is swept from a high frequency to a low frequency and when the frequency is swept from a low frequency to a high frequency. Therefore, it is preferable to drive the piezoelectric transformer in the frequency range higher than the frequency at which the voltage step-up ratio is at the maximum value from the viewpoint of the reliability and the operational characteristics thereof.

In this embodiment, the first driving control portion 201*a* and the second driving control portion 201*b* are provided to sweep the driving frequency of the piezoelectric transformer from a high frequency to a low frequency, as shown by the arrows in FIG. 6, at the time of the start of the operation, and stop this sweeping operation during the steady operation. Thus, the operation in the unstable region Ru of the piezoelectric transformer can be prevented by carrying out the operation in the frequency range higher than the frequency at which the voltage step-up ratio SR is at the maximum value.

The above-described operation makes it possible to provide a highly reliable inverter system.

Furthermore, driving can be performed at a fixed frequency during the steady operation, and when adjusting brightness with the phase difference, driving can be performed at a driving frequency near the frequency that can provide high efficiency to the piezoelectric transformer. Therefore, a high efficient and compact inverter system that is suitable for driving a plurality of piezoelectric transformers can be realized.

Furthermore, only one of the cold cathode fluorescent tubes can be turned off by setting the phase difference between the driving control signals S1 and S2 and the driving control signals S3 and S4 or the phase difference between the driving control signals S1 and S2 and the driving control signals S5 and S6 to zero. The control in this manner makes it possible to perform the individual control of a plurality of cold cathode fluorescent tubes during their operation, as shown in FIG. 4 (S108*a* shows the state of the cold cathode fluorescent tube 108*a,* and S108*b* shows the state of the cold cathode fluorescent tube 108*b*).

Furthermore, it is possible to control the brightness of each of the cold cathode fluorescent tubes 108*a* and 108*b* individually by making the first reference voltage Vref1 and the second reference voltage Vref2 different.

Moreover, if the phase is controlled on the order of several tens of ms, a protrusion in the output voltage from the piezoelectric transformer can be eliminated at the start of the operation of the cold cathode fluorescent tube, and the operation start voltage of the cold cathode fluorescent tube can be lowered.

In this embodiment, the piezoelectric transformer having the conventional structure shown in FIG. 21 is used. However, the same effect can be obtained with piezoelectric transformers having other structures, as long as they step up or down a voltage input from the primary side by the piezoelectric effect and output the voltage from the secondary side.

In this embodiment, the cold cathode fluorescent tube is used as the load of the piezoelectric transformer. However, the same effect can be obtained by using the light emission control device and the control method described in this embodiment, even if a load in which the impedance is not varied such as a resistance load is used.

Third Embodiment

FIGS. 8A, 8B, 8C and 8D are diagrams of an input voltage Vi to a first resonance portion 120*a* when the phase difference between the driving control signals S1, and S4 and S6 is zero, the phase difference between the driving control signals S1, and S4 and S6 is θb, the phase difference between the driving control signals S1, and S4 and S6 is θc (θc>θb), and a change of the phase difference between the driving control signals S1, and S4 and S6 over time in a light emission control device according to a third embodiment of the present invention, respectively.

This embodiment is different from the second embodiment in the control method at the start of the operation and is the same as the second embodiment in other structural and operation aspects.

Figure 8A:
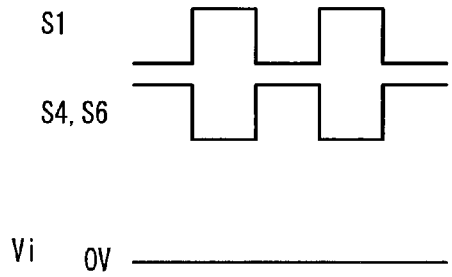
FIG. 8A is a waveform diagram of an input voltage Vi to a first resonance portion 120*a* when the phase difference between the driving control signals S1, and S4 and S6 is zero in a light emission control device according to a third embodiment of the present invention.
Figure 8B:
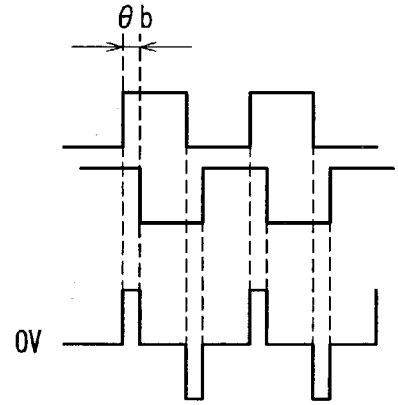
FIG. 8B is a waveform diagram of an input voltage Vi to the first resonance portion 120*a* when the phase difference between the driving control signals S1, and S4 and S6 is θb in the light emission control device according to the third embodiment of the present invention.
Figure 8C:
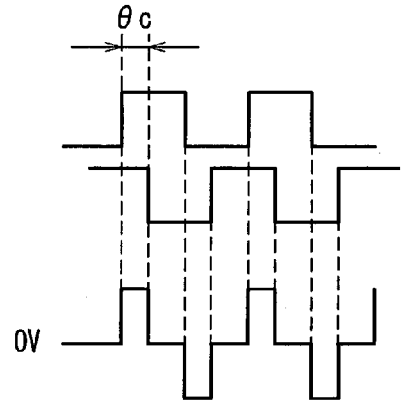
FIG. 8C is a waveform diagram of an input voltage Vi to the first resonance portion 120*a* when the phase difference between the driving control signals S1, and S4 and S6 is θc (θc>θb) in the light emission control device according to the third embodiment of the present invention.
Figure 8D:
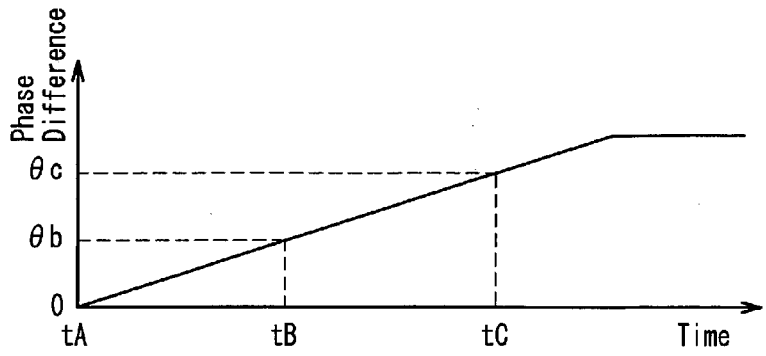
FIG. 8D is a diagram showing a change of the phase difference between the driving control signals S1, and S4 and S6 over time in the light emission control device according to the third embodiment of the present invention.

The driving control at the start of the operation in this embodiment is performed only with the phase difference of the driving control signals. However, as shown in FIG. 7, when the piezoelectric transformer is operated at a large amplitude, there is an unstable region Ru in which the jump phenomenon is exhibited at a frequency lower than the frequency at which the voltage step-up ratio SR is at the maximum value. Therefore, in the driving at a single frequency, first, the phase difference between the driving control signal S1 (S2) and the driving control signal S4 (S3) and the phase difference between the driving control signal S1 (S2) and the driving control signal S6 (S5) are set to zero. Then, as shown in FIG. 8D, the phase difference is increased gradually so that the input power to the piezoelectric transformer is increased. As a result, the output voltage from the piezoelectric transformer gradually becomes higher, and when the output voltage reaches the operation start voltage of the cold cathode fluorescent tube, the cold cathode fluorescent tube starts to be turned on.

The control in this manner makes it possible to avoid an unstable operation even at the operation start in the frequency region lower than the frequency at which the voltage step-up ratio is at the maximum value. Thus, driving at a single frequency is possible and a compact circuitry can be realized.

Furthermore, only one of the cold cathode fluorescent tubes can be turned off by setting the phase difference between the driving control signals S1 and S2 and the driving control signals S3 and S4 or the phase difference between the driving control signals S1 and S2 and the driving control signals S5 and S6 to zero. The control in this manner makes it possible to perform individual control of a plurality of cold cathode fluorescent tubes during their operation, as shown in FIG. 4 (S108*a* shows the state of the cold cathode fluorescent tube 108*a,* and S108*b* shows the state of the cold cathode fluorescent tube 108*b*).

Furthermore, it is possible to control the brightness of each of the cold cathode fluorescent tubes 108*a* and 108*b* individually by making the first reference voltage Vref1 and the second reference voltage Vref2 different.

Moreover, if the phase is controlled on the order of several tens of ms, a protrusion in the output voltage from the piezoelectric transformer can be eliminated at the start of the operation of the cold cathode fluorescent tube, and the operation start voltage of the cold cathode fluorescent tube can be lowered.

In this embodiment, the piezoelectric transformer having the conventional structure shown in FIG. 21 is used. However, the same effect can be obtained with piezoelectric transformers having other structures, as long as they step up or down a voltage input from the primary side by the piezoelectric effect and output the voltage from the secondary side.

In this embodiment, the cold cathode fluorescent tube is used as the load of the piezoelectric transformer. However, the same effect can be obtained by using the light emission control device and the control method described in this embodiment, even if a load in which the impedance is not varied such as a resistance load is used.

Fourth Embodiment

Figure 9:
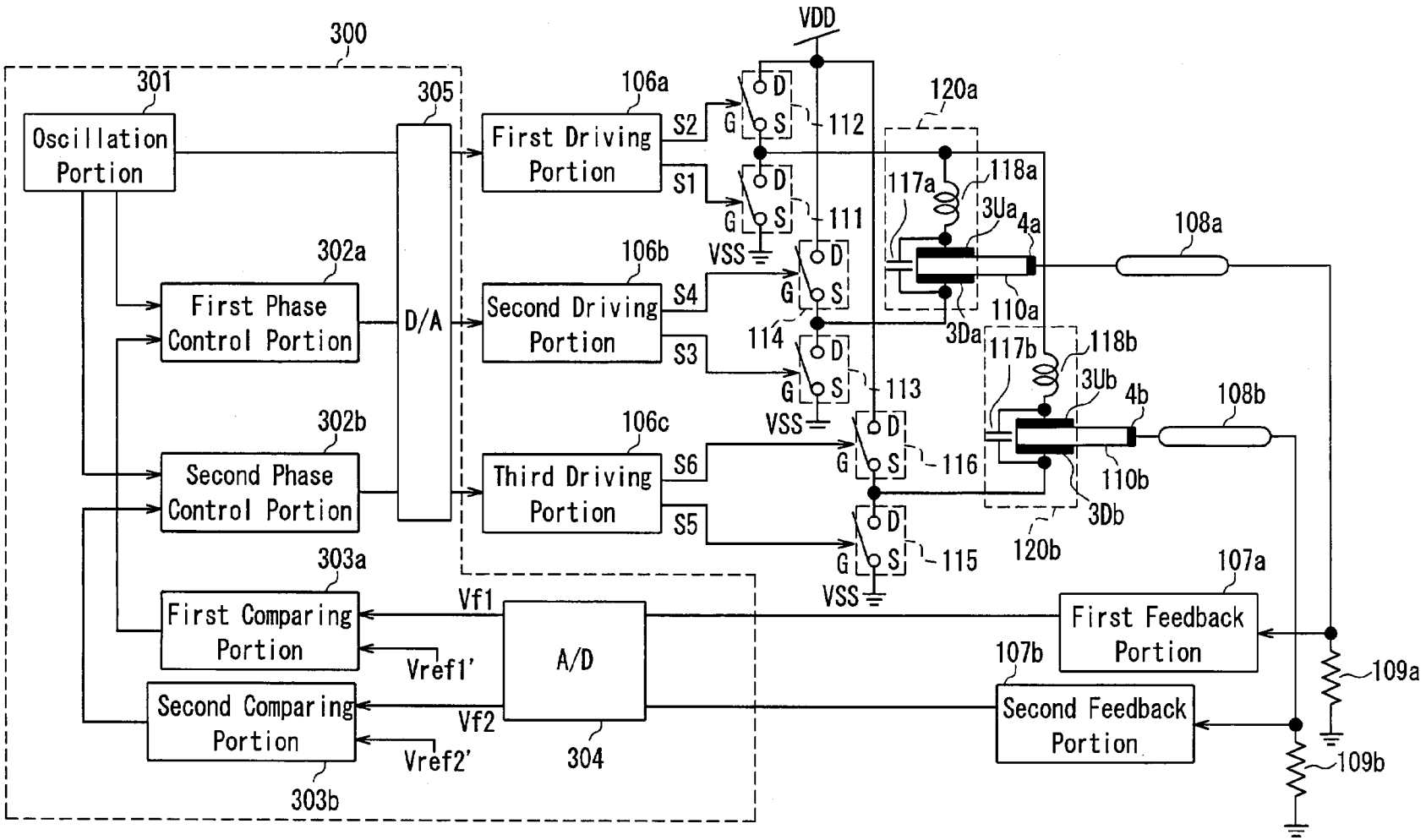
FIG. 9 is a block diagram showing an example of the structure of a light emission control device according to a fourth embodiment of the present invention.

FIG. 9 is a block diagram showing an example of the structure of a light emission control device according to a fourth embodiment of the present invention.

This embodiment is different from the first embodiment in the following aspect. A first comparing portion 303*a,* a second comparing portion 303*b,* a first phase control portion 302*a,* a second phase control portion 302*b,* and an oscillation portion 301 constitute a digital control portion 300 in a microcomputer. A built-in analog/digital converter (A/D) 304 converts analog detected voltages from the first feedback portion 107*a* and the second feedback portion 107*b* to digital detected data. Similarly, a built-in digital/analog converter (D/A) 305 converts digital signals from the oscillation portion 301, the first phase control portion 302*a,* and the second phase control portion 302*b* to analog signals, and the analog signals are output to the first driving portion 106*a,* the second driving portion 106*b,* and the third driving portion 106*c,* respectively. In this manner, digital control is performed in this embodiment.

In FIG. 9, alternating voltages detected by the first current detection resistor 109*a* and the second current detection resistor 109*b* are rectified by the first feedback portion 107*a* and the second feedback portion 107*b,* respectively, and are input to the A/D 304. The detection data converted to digital data by the A/D 304 are input to the first comparing portion 303*a* and the second comparing portion 303*b,* respectively.

The first comparing portion 303*a* and the second comparing portion 303*b* compare the detection data output from the A/D 304 with the first reference data Vref1' and the second reference data Vref2', respectively. When the respective detection data are larger than the first reference data Vref1' and the second reference data Vref2', control signals are output to the first phase control portion 302*a* and the second phase control portion 302*b*, respectively, such that the input voltages to the first piezoelectric transformer 110*a* and the second piezoelectric transformer 110*b* become small. When the respective detection data are smaller than the first reference data Vref1' and the second reference data Vref2', control signals are output to the first phase control portion 302*a* and the second phase control portion 302*b*, respectively, such that the input voltages to the first piezoelectric transformer 110*a* and the second piezoelectric transformer 110*b* become large.

The first phase control portion 302*a* and the second phase control portion 302*b* supply signals to the second driving portion 106*b* and the third driving portion 106*c* in accordance with the output signals from the first comparing portion 303*a* and the second comparing portion 303*b* so as to control the input power to the first piezoelectric transformer 110*a* and the second piezoelectric transformer 110*b*.

Next, the operation of the light emission control device configured as above will be described. The relationships between the driving control signals S1 and S2 from the first driving portion 106*a*, the driving control signals S3 and S4 from the second driving portion 106*b* and the driving control signals S5 and S6 from the third driving portion 106*c*, and the input voltage Vi1 and Vi2 to the first piezoelectric transformer 110*a* and the second piezoelectric transformer 110*b* are the same as those in the first embodiment and the second embodiment.

When the light emission control device is started up, the phase difference between the driving control signals S1 and S2 from the first driving portion 106*a* and the driving control signals S3 and S4 from the second driving portion 106*b* and the phase difference between the driving control signals S1 and S2 from the first driving portion 106*a* and the driving control signals S5 and S6 from the third driving portion 106*c* are set to zero. Thereafter, the phase difference is controlled by the first phase control portion 302*a* and the second phase control portion 302*b* such that an operation start voltage can be output. In this case, the driving frequencies of the first piezoelectric transformer 110*a* and the second piezoelectric transformer 110*b* are constant.

After the cold cathode fluorescent tube 108*a* is turned on, the first phase control portion 302*a* supplies a control signal to the second driving portion 106*b* in accordance with an error signal from the first comparing portion 303*a* so that the phase difference between the driving control signals S1 and S2 and the driving control signals S3 and S4 is controlled such that the brightness of the cold cathode fluorescent tube 108*a* is constant. Similarly, after the cold cathode fluorescent tube 108*b* is turned on, the second phase control portion 302*b* supplies a control signal to the third driving portion 106*c* in accordance with an error signal from the second comparing portion 303*b* so that the phase difference between the driving control signals S1 and S2 and the driving control signals S5 and S6 is controlled such that the brightness of the cold cathode fluorescent tube 108*b* is constant.

The driving control in this manner makes it possible to drive the piezoelectric transformer with a single frequency and to keep the brightness of the cold cathode fluorescent tube constant during the operation of the cold cathode fluorescent tube. In this case, the driving frequency of the piezoelectric transformer is constant.

Next, the phase difference control by the digital control portion 300 will be described with reference to FIG. 10.

Figure 10:
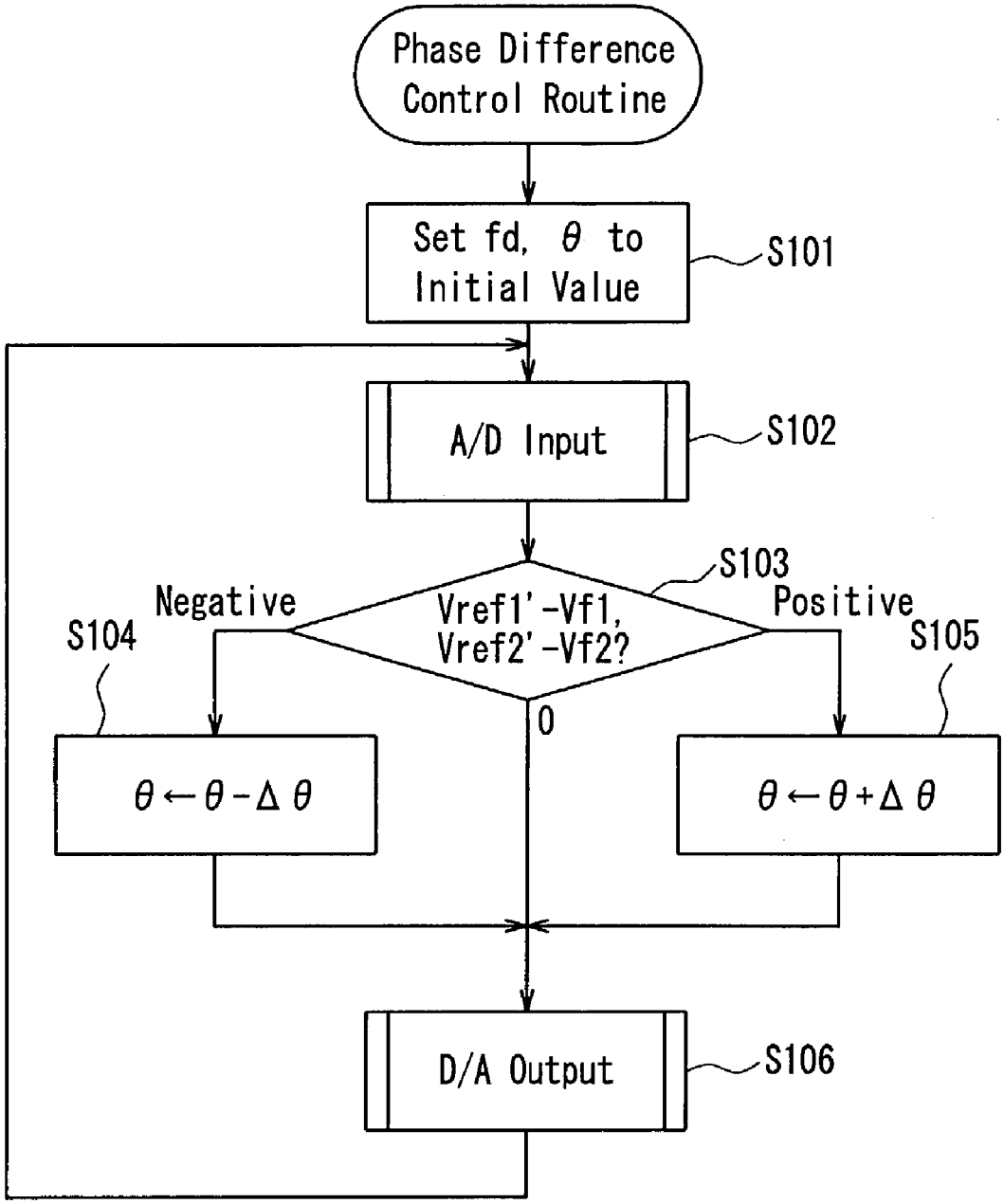
FIG. 10 is a flowchart showing the process procedure in a phase difference control routine by the digital control portion 300 shown in FIG. 9.

FIG. 10 is a flowchart showing the procedure in a phase difference control routine by the digital control portion 300. First, when the light emission control device is started up, the driving frequency fd and the phase difference θ of driving control signals are set to the initial values (S101). In this embodiment, the initial value of the phase difference θ is zero. However, there is no problem even if the initial value of the phase difference θ is not zero, as long as the output voltage from the piezoelectric transformer is not more than the operation start voltage of the cold cathode fluorescent tube.

Then, the detected voltages from the first feedback portion 107*a* and the second feedback portion 107*b* are input to the A/D 304 in the digital control portion 300 (S102), and the analog values are converted to digital detection data Vf1 Vf2. Then, the detection data Vf1 and Vf2 are compared with the reference data Vref1' and Vref2' by the first comparing portion 303*a* and the second comparing portion 303*b*, respectively (S103). When Vref1'−Vf1 or Vref2'−Vf2 is positive, the phase difference θ is increased by a change width Δθ corresponding to one step (S105), and D/A output of the resultant phase difference is performed from the first phase control portion 302*a* to the second driving portion 106*b*, or from the second phase control portion 302*b* to the third driving portion 106*c* (S106).

On the other hand, when as a result of the determination at S103, Vref1'−Vf1 or Vref2'−Vf2 is negative, the phase difference θ is decreased by a change width Δθ corresponding to one step (S104), and D/A output of the resultant phase difference is performed from the first phase control portion 302*a* to the second driving portion 106*b*, or from the second phase control portion 302*b* to the third driving portion 106*c* (S106). When as a result of the determination at S103, detection data Vf1 and Vf2 are substantially equal to the reference data Vref1' and Vref2', respectively (Vref1'−Vf1=0, Vref2'−Vf2=0), the phase difference is unchanged and D/A output is performed from the first phase control portion 302*a* to the second driving portion 106*b*, or from the second phase control portion 302*b* to the third driving portion 106*c* (S106). Here, one step corresponding to a change width Δθ of the phase difference is varied depending on the reference clock RCLK, etc., of the microcomputer.

Figure 11:
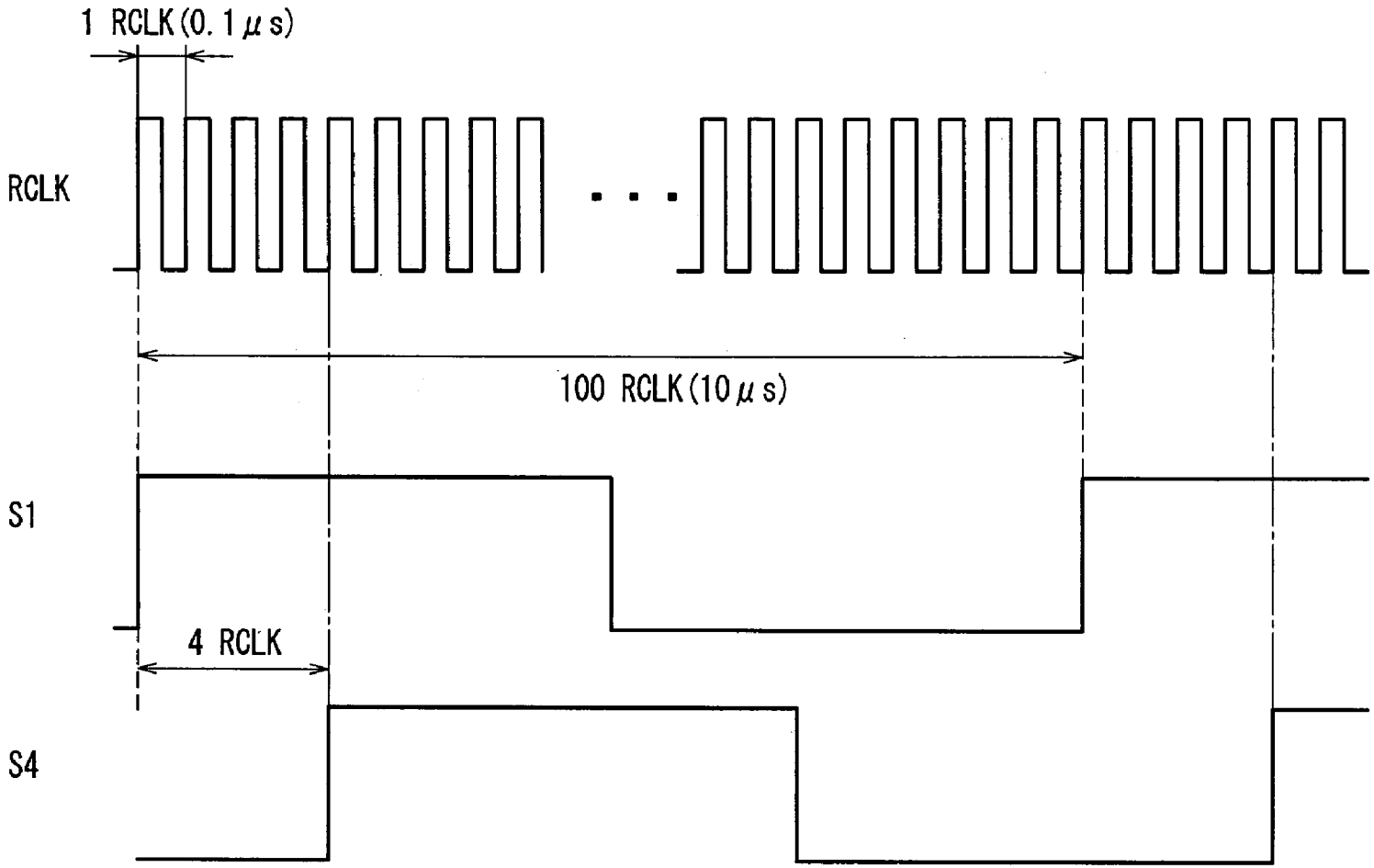
FIG. 11 is a timing chart showing an example of the timing relationship between the reference clock RCLK and the driving control signals S1 and S4 in the fourth embodiment of the present invention.

FIG. 11 is a timing chart showing an example of the timing relationship between the reference clock RCLK of the microcomputer and the driving control signals S1 and S4 that are generated from the reference clock RCLK by the oscillation portion 301 and are output from the first driving portion 106*a*. In the light emission control device of this embodiment, a driving control signal whose one cycle (10 μs) is constituted by 100 clocks (100 RCLK) when taking 10 MHz as the frequency of the reference clock RCLK of the microcomputer (the cycle is 0.1 μs) is used for example. The phase difference is controlled, using a change width corresponding to one clock of the reference clock RCLK as the change width Δθ for one step.

Figure 12:
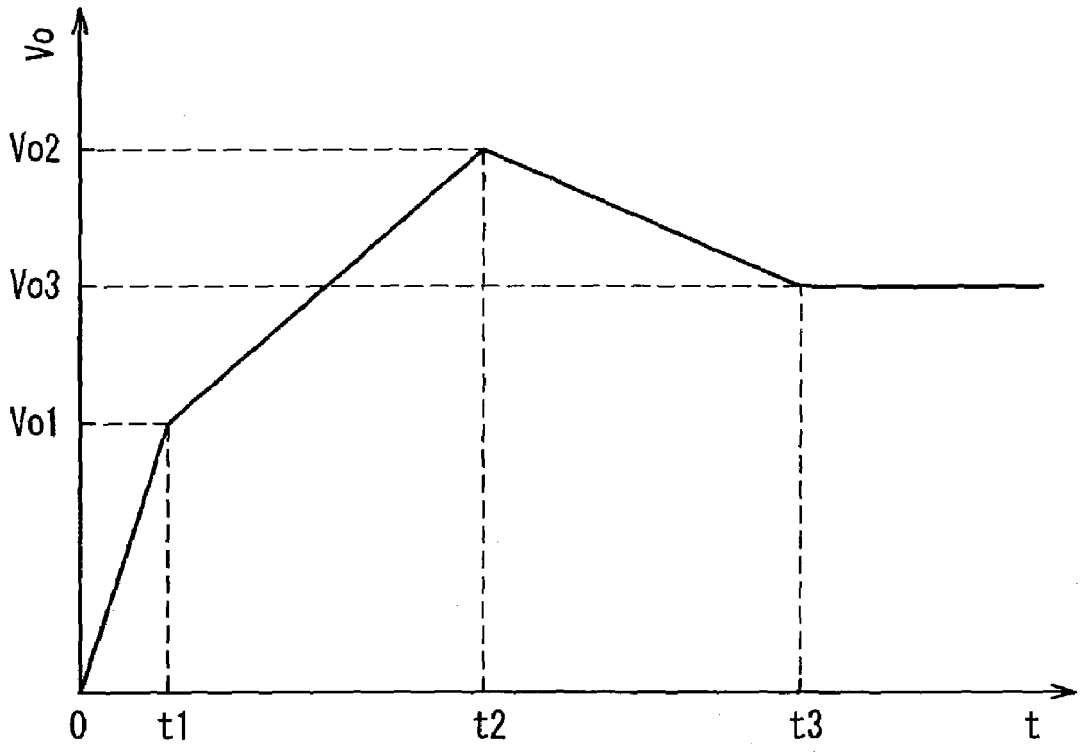
FIG. 12 is a diagram showing a change of an output voltage Vo of the piezoelectric transformer over time from the time of the start in the start control by the digital control portion 300 shown in FIG. 9.

It is possible to decrease the voltage at the start of the operation of the cold cathode fluorescent tube by controlling the start as shown in FIG. 12. FIG. 12 is a diagram showing a change of an output voltage (an alternating voltage amplitude applied to the cold cathode fluorescent tube) Vo of the piezoelectric transformer over time from the time of the start by the light emission control device.

Hereinafter, the start control method of FIG. 12 will be described. First, at the time of the start of the light emission device (time t=0), the phase difference and the driving frequency of the driving control signals are set to the respective initial values, and an output voltage Vo is increased until the Vo of the piezoelectric transformer becomes a voltage Vo1 (time t=t1) by the phase difference control. Here, Vo1 is a voltage at which the cold cathode fluorescent tube is partly turned on. The "partly turned on" means that the cold cathode fluorescent emits light only in the vicinity of one of the electrodes.

Thereafter, the phase difference is controlled to increase the output voltage Vo of the piezoelectric transformer to a voltage Vo2 (time t=t2) so that the cold cathode fluorescent tube is fully turned on. This time t2 is quite a long time, compared with the time t1. It is possible to decrease the voltage at the operation start, for example, by setting the time t1 to be on the order of several tens μs, and the time t2 to be on the order of several ms.

After the cold cathode fluorescent tube is turned on, the phase difference is controlled so as to obtain a predetermined brightness, and the voltage reaches a voltage Vo3, which is the operation maintaining voltage (time t=t3).

As described above, according to this embodiment, even if a plurality of piezoelectric transformers are provided in order to turn on a plurality of cold cathode fluorescent tubes, it is possible to control each power individually, and a compact and high efficient circuitry can be achieved.

Furthermore, only one of the cold cathode fluorescent tubes can be turned off by setting the phase difference between the driving control signals S1 and S2 and the driving control signals S3 and S4 or the phase difference between the driving control signals S1 and S2 and the driving control signals S5 and S6 to zero. The control in this manner makes it possible to perform individual control of a plurality of cold cathode fluorescent tubes during their operation, as shown in FIG. 4 (S108*a* shows the state of the cold cathode fluorescent tube 108*a,* and S108*b* shows the state of the cold cathode fluorescent tube 108*b*).

Furthermore, it is possible to control the brightness of each of the cold cathode fluorescent tubes 108*a* and 108*b* individually by making the first reference voltage Vref1 and the second reference voltage Vref2 different.

In this embodiment, the piezoelectric transformer having the conventional structure shown in FIG. 21 is used. However, the same effect can be obtained with piezoelectric transformers having other structures, as long as they step up and down a voltage input from the primary side by the piezoelectric effect and output the voltage from the secondary side.

In this embodiment, the cold cathode fluorescent tube is used as the load of the piezoelectric transformer. However, the same effect can be obtained by using the light emission control device and the control method described in this embodiment, even if a load in which the impedance is not varied such as a resistance load is used.

Figure 13:
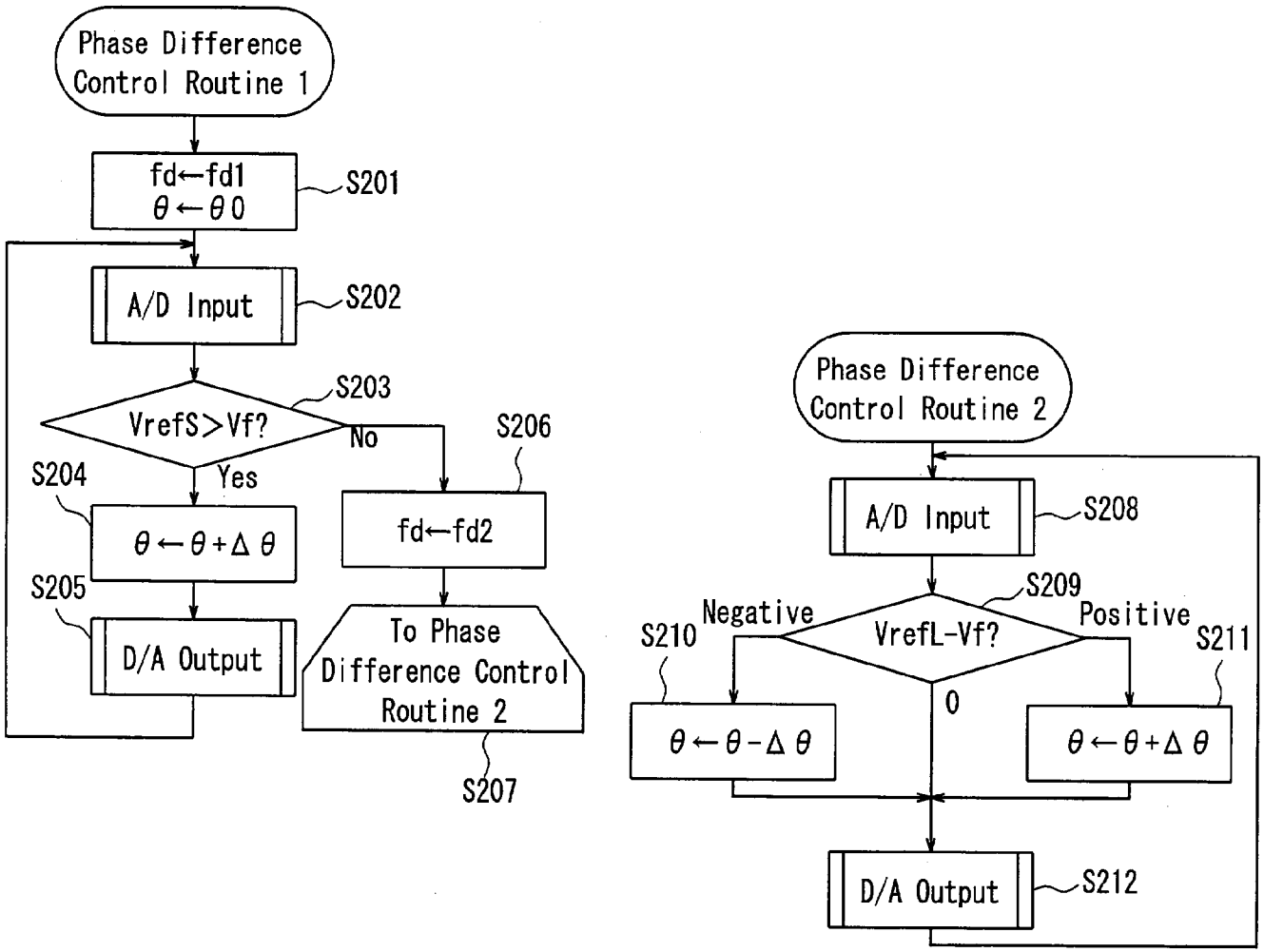
FIG. 13 is a flowchart showing the procedure in a phase difference control routine 1 before the cold cathode fluorescent tube is turned on and a phase difference control routine 2 while the cold cathode fluorescent tube is steadily turned on in a modified example of a driving control method by the digital control portion 300 shown in FIG. 9.
Figure 14:
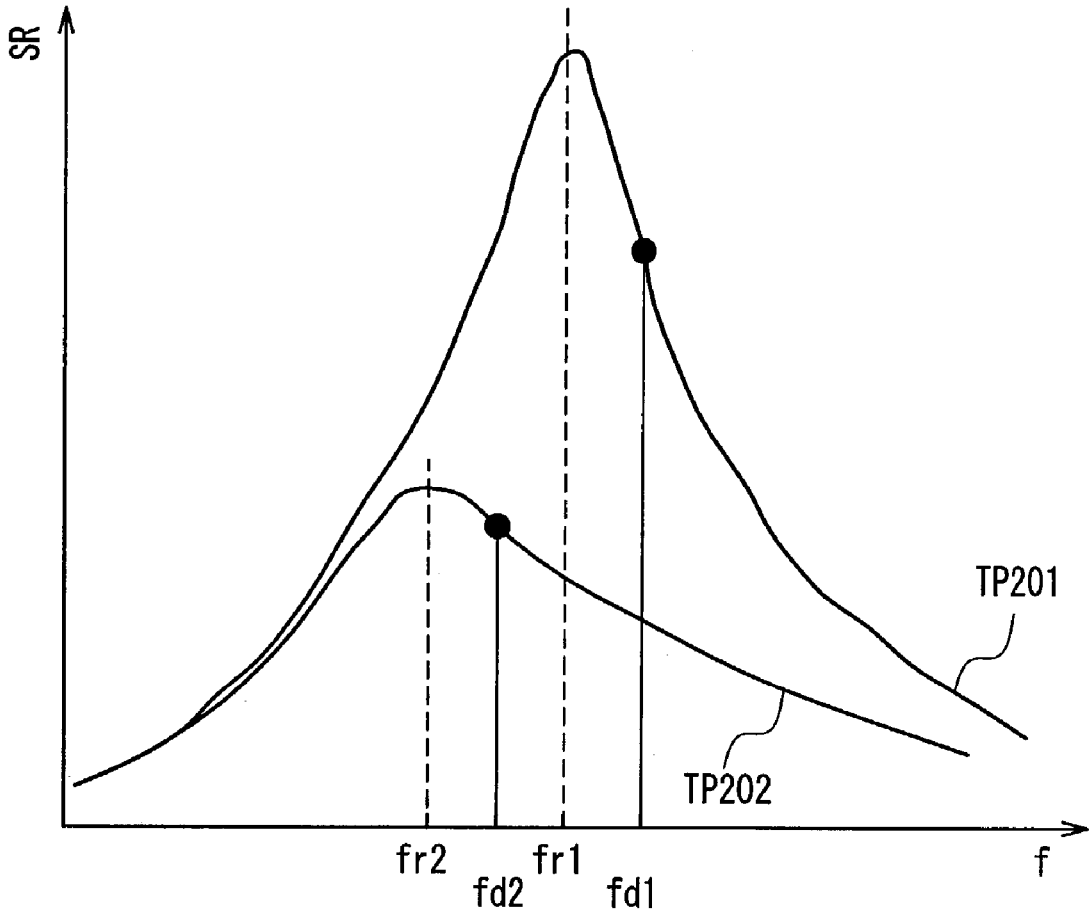
FIG. 14 is a graph showing the frequency characteristics of the voltage step-up ratio of the piezoelectric transformer before and after the cold cathode fluorescent tube is turned on in the driving control method with the flowchart of FIG. 13.

In this embodiment, driving is performed with the same frequency before the start of the operation and during the steady operation of the cold cathode fluorescent tube. However, driving can be performed in accordance with the load variation of the cold cathode fluorescent tube, as shown in FIG. 13. That is, before the start of the operation, driving can be performed according to the phase difference control routine 1 in which the driving frequency fd is fixed to fd1 (FIG. 14) and the phase difference is changed, whereas during the steady operation, driving can be performed according to the phase difference control routine 2 in which the driving frequency fd is fixed to fd2 (FIG. 14) and the phase difference is changed. Hereinafter, this driving control will be described with reference to FIGS. 13 and 14.

In FIG. 13, before the start of the operation, the following process is repeated according to the phase difference control routine 1. The driving frequency fd is set to a driving frequency fd1 that is higher than the resonant frequency fr1 at which the voltage step-up ratio SR is at the maximum value under no load for the piezoelectric transformer, as shown in a curve TP201 of FIG. 14, and the phase difference is set to the initial value θ0 (S201). The detection data Vf is input to the A/D 304 (S202). It is determined whether or not the detection data Vf has reached the reference data VrefS, which corresponds to the operation start voltage (S203). When it has not been reached yet (YES: VrefS>Vf), the phase difference θ is increased by the change width Δθ corresponding to one step (S204) and its D/A output is performed (S205).

As a result of the determination at S203, when the detection data Vf has reached the reference data VrefS, which corresponds to the operation start voltage (NO: VrefS≦Vf), the driving frequency fd is set to a driving frequency fd2 that is higher than the resonant frequency fr2 at which the voltage step-up ratio SR is at the maximum value during the operation of the cold cathode fluorescent tube, as shown in a curve TP202 of FIG. 14 (S206), and the processing is shifted to the phase difference control routine 2 (S207).

During the steady operation, the following process is performed according to the phase difference control routine 2. The detection data Vf is input to the A/D 304 (S208). The detection data Vf is compared with the reference data VrefL, which corresponds to the operation maintaining voltage (S209). When VrefL−Vf is positive, the phase difference θ is increased by the change width Δθ corresponding to one step (S211) and its D/A output is performed (S212).

On the other hand, as a result of the determination at S209, when VrefL−Vf is negative, the phase difference θ is decreased by the change width Δθ corresponding to one step (S210) and its D/A output is performed (S212). As a result of the determination at S209, when the detection data Vf is substantially equal to the reference data VrefL (VrefL−Vf=0), the phase difference is unchanged and its D/A output is performed (S212).

According to this driving control, it is ensured that the piezoelectric transformer can be driven at a frequency range that is hither than the frequency at which the voltage step-up ratio is at the maximum value. Therefore, the piezoelectric transformer can be prevented from being driven in the unstable region Ru as shown in FIG. 7. As a result, a highly reliable inverter system can be realized.

Figure 15:
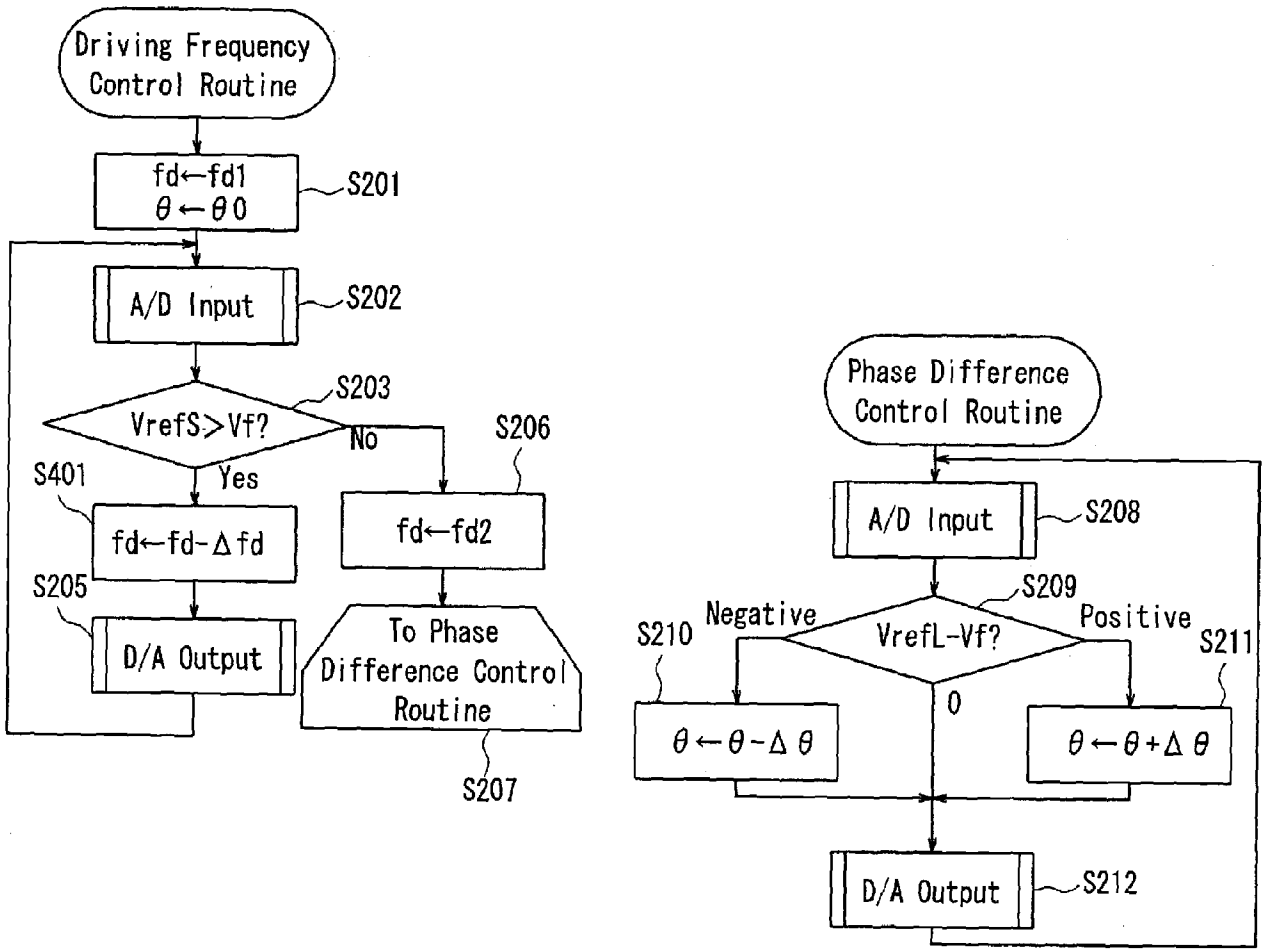
FIG. 15 is a flowchart showing the procedure in a driving frequency control routine before the cold cathode fluorescent tube is turned on and a phase difference control routine while the cold cathode fluorescent tube is steadily turned on in a modified example of a driving control method by the digital control portion 300 shown in FIG. 9.

In the driving control of FIG. 13, the driving control of the piezoelectric transformer is performed only with the phase difference. However, as shown in FIG. 15, at the time of the start of the operation of the cold cathode fluorescent tube, the piezoelectric transformer can be driven according to the driving frequency control routine in which the phase difference θ is fixed to the initial θ0 value, and the driving frequency fd is swept from the initial value fd1 to a lower frequency. On the other hand, during the steady operation, the piezoelectric transformer can be driven according to the phase difference control routine in which the driving frequency fd is fixed to fd2, and the phase difference θ is changed. The process in FIG. 15 is different from that in FIG. 13 only in the process in which when the detection data Vf has not reached the reference VrefS corresponding to the operation start voltage, the driving frequency fd is decreased by the change width Δfd corresponding to one step. Other processes are shown with the same numerals as in FIG. 13 and are not described further.

According to this driving control, driving can be performed at a frequency higher than the frequency at which the voltage step-up ratio is at the maximum value, and therefore a highly reliable system can be configured.

Fifth Embodiment

Figure 16:
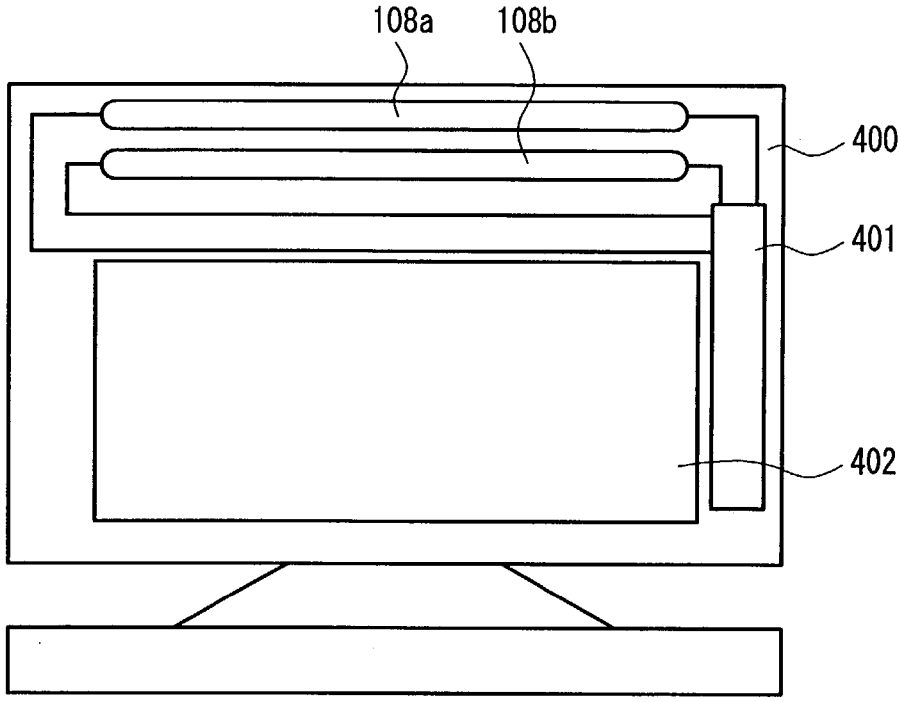
FIG. 16 is a schematic view showing the structure of a liquid crystal monitor according to a fifth embodiment of the present invention.

FIG. 16 is a schematic view showing the structure of a liquid crystal monitor 400 according to a fifth embodiment of the present invention. In FIG. 16, a plurality of cold cathode fluorescent tubes 108*a* and 108*b* and a piezoelectric inverter circuit 401 constitute a light emission control device according to any one of the first to the third embodiments. A liquid crystal panel 402 is illuminated with the plurality of cold cathode fluorescent tubes 108*a* and 108*b*.

In the thus configured liquid crystal monitor 400, the piezoelectric inverter circuit 401 for a liquid crystal backlight can be compact and highly efficient operation can be achieved. Furthermore, this liquid crystal monitor is advantageous in that the strain of the driving voltage waveform of the piezoelectric transformer can be reduced.

Sixth Embodiment

In the fifth embodiment of the present invention, the piezoelectric inverter circuit 401 and a liquid crystal driver (not shown) that generates various signals for controlling the driving of the liquid crystal panel are configured separately. However, the digital control portion 300 in the light emission control device of the fourth embodiment can be configured within the liquid crystal driver. This configuration will be described as a sixth embodiment below.

Figure 17:
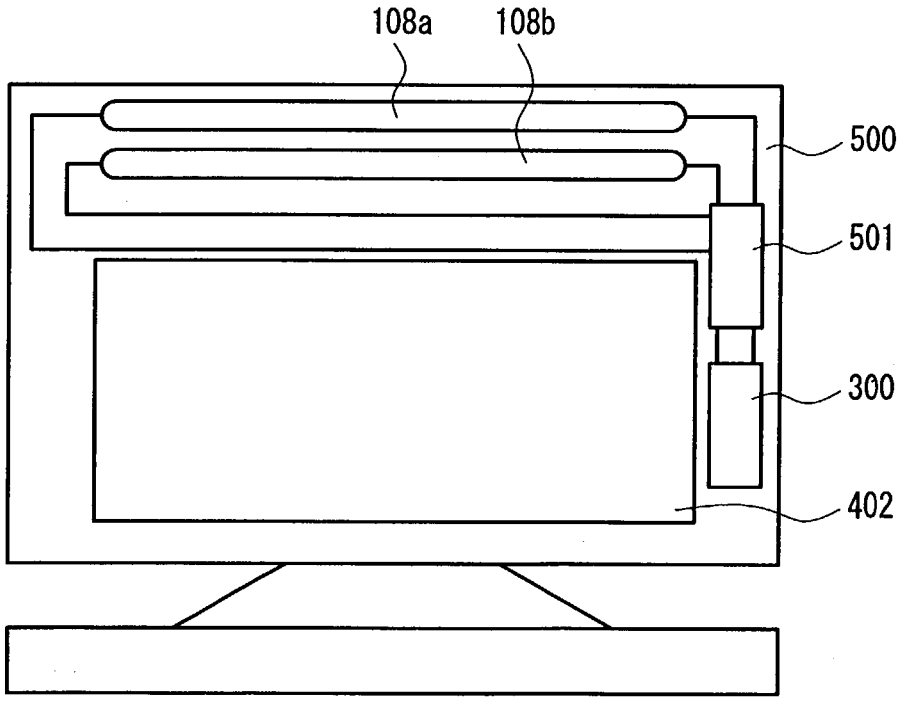
FIG. 17 is a schematic view showing the structure of a liquid crystal monitor according to a sixth embodiment of the present invention.

FIG. 17 is a schematic view showing the structure of a liquid crystal monitor 500 according to a sixth embodiment of the present invention. In FIG. 17, reference numeral 501 denotes an analog circuit portion in which the digital control portion 300 and the cold cathode fluorescent tube 108*a* and 108*b* are removed from the light emission control device shown in FIG. 9.

According to this embodiment, the digital control portion 300 for the piezoelectric transformer is included in the liquid crystal driver, so that the number of the components can be reduced. Furthermore, this embodiment is advantageous in that the brightness of the cold cathode fluorescent tube can be controlled easily in accordance with the images.

In the fifth and the sixth embodiments, the liquid crystal monitors have been described, but the present invention is not limited thereto and can be applied preferably to equipment employing, especially a large liquid crystal panel, such as a liquid crystal television.

Seventh Embodiment

In the first to the fourth embodiments, a conventional Rosen type piezoelectric transformer with one output on the secondary side shown in FIG. 21 is used, and one cold cathode fluorescent tube is connected to one secondary electrode of each piezoelectric transformer. In a seventh embodiment of the present invention, a conventional balanced output type piezoelectric transformer with two outputs on the secondary side is used, and a plurality of cold cathode fluorescent tubes are connected to two secondary electrodes of each piezoelectric transformer.

Figure 18:
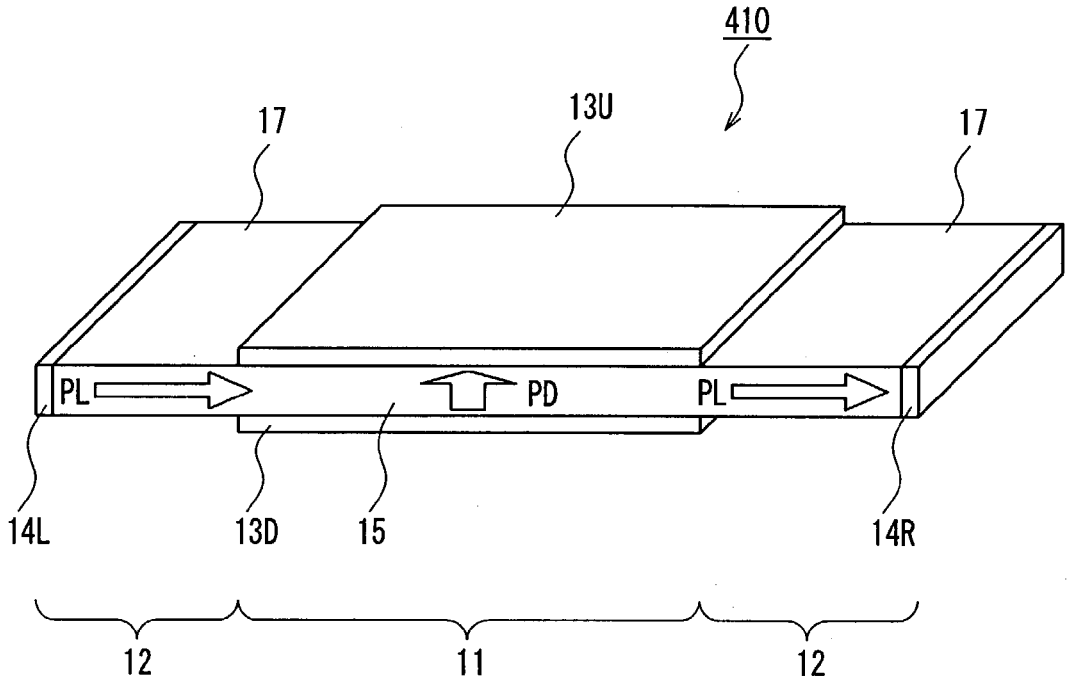
FIG. 18 PRIOR ART
FIG. 18 is a perspective view showing the schematic structure of a conventional balanced output type piezoelectric transformer.

FIG. 18 is a perspective view showing the schematic structure of a conventional balanced output type piezoelectric transformer 410 with two outputs on the secondary side. Referring to FIG. 18, this piezoelectric transformer includes a low impedance portion 11, a high impedance portion 12, primary electrodes 13U and 13D as input electrodes, secondary electrodes 14L and 14R as output electrodes, and piezoelectric elements 15 and 17. The polarization direction of the piezoelectric element 15 in the low impedance portion 11 is denoted by PD, and the polarization direction of the piezoelectric element 17 in the high impedance portion 12 is denoted by PL.

The low impedance portion 11 of the piezoelectric transformer 410 is an input portion when the transformer is used to step up a voltage. In the low impedance portion 11, polarization is provided in the thickness direction as shown in the polarization direction PD, and the primary electrodes 13U and 13D are provided in the principal surface and the back thereof, respectively, in the thickness direction in substantially the center of the longitudinal direction. The high impedance portion 12 is an output portion when the transformer is used to step up a voltage. In the high impedance portion 12, polarization is provided in the longitudinal direction as shown in the polarization direction PL, and one secondary electrode 14L is provided in one end face in the longitudinal direction and the other secondary electrode 14R is provided in the other end face in the longitudinal direction. When a predetermined alternating voltage near the resonant frequency of vibration that expands and contracts in the longitudinal direction of the piezoelectric transformer 410 is applied between the primary electrodes 13U and 13D, the piezoelectric transformer 410 excites mechanical vibration in the longitudinal direction and converts this mechanical vibration to a voltage generated in accordance with the impedance ratio between the low impedance portion 11 and the high impedance portion 12 by the piezoelectric effect. Then, the voltage is output from a pair of electrodes 14L and 14R, which are the secondary electrodes. The voltage output from one secondary electrode 14L has a phase that is 180 degrees different from that of the voltage output from the other secondary electrode 14R, and therefore such a piezoelectric transformer 410 with two outputs on the secondary side is called a balanced output type.

Figure 19:
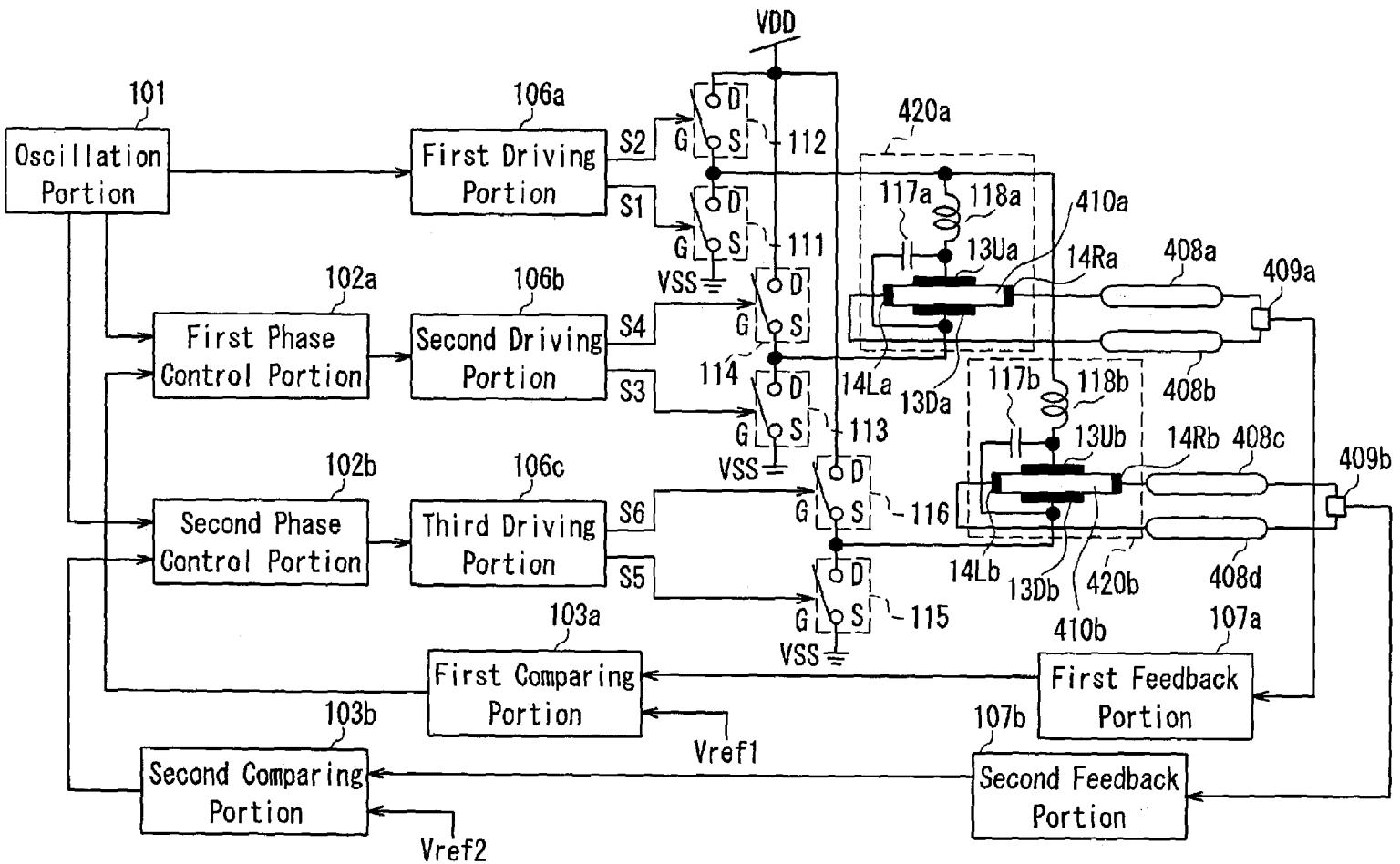
FIG. 19 is a block diagram showing an example of the structure of a light emission control device according to a seventh embodiment of the present invention.

FIG. 19 is a block diagram showing an example of the structure of a light emission control device according to a seventh embodiment of the present invention.

This embodiment is different from the first embodiment in the following aspects. The first and the second piezoelectric transformers are of the balanced output type with two outputs on the secondary side; a plurality of (two in this embodiment) cold cathode fluorescent tubes are connected to a pair of secondary electrodes of each piezoelectric transformer; and each cold cathode fluorescent tube is floated by a current detecting portion. Other structural and operation aspects of this embodiment are the same as those of the first embodiment. Therefore, different aspects from the first embodiment primarily will be described below.

The input voltages to primary electrodes 13Ua and 13Da of a first piezoelectric transformer 410*a* are stepped up by the piezoelectric effect and are output as high voltages having 180 degree different phases from a pair of secondary electrodes 14La and 14Ra. The input voltages to primary electrodes 13Ub and 13Db of a second piezoelectric transformer 410*b* are stepped up by the piezoelectric effect and are output as high voltages having 180 degree different phases from a pair of secondary electrodes 14Lb and 14Rb.

The high voltages output from the pair of secondary electrodes 14La and 14Ra of the first piezoelectric transformer 410*a* are applied to a sixth serially-connected element in which a first cold cathode fluorescent tube group including a plurality of cold cathode fluorescent tubes 408*a* and 408*b* is connected to a first current detecting portion 409*a* disposed between the cold cathode fluorescent tubes 408*a* and 408*b*. The high voltages output from the pair of secondary electrodes 14Lb and 14Rb of the second piezoelectric transformer 410*b* are applied to a seventh serially-connected element in which a second cold cathode fluorescent tube group including a plurality of cold cathode fluorescent tubes 408*c* and 408*d* is connected to a second current detecting portion 409*b* disposed between the cold cathode fluorescent tubes 408*c* and 408*d*.

An alternating voltage detected by the first current detecting portion 409*a* while the cold cathode fluorescent tubes 408*a* and 408*b* are floated is rectified by a first feedback portion 107*a* and is input to a first comparing portion 103*a*. An alternating voltage detected by the second current detecting portion 409*b* while the cold cathode fluorescent tubes 408*c* and 408*d* are floated is rectified by a second feedback portion 107*b* and is input to a second comparing portion 103*b*.

Figure 20:
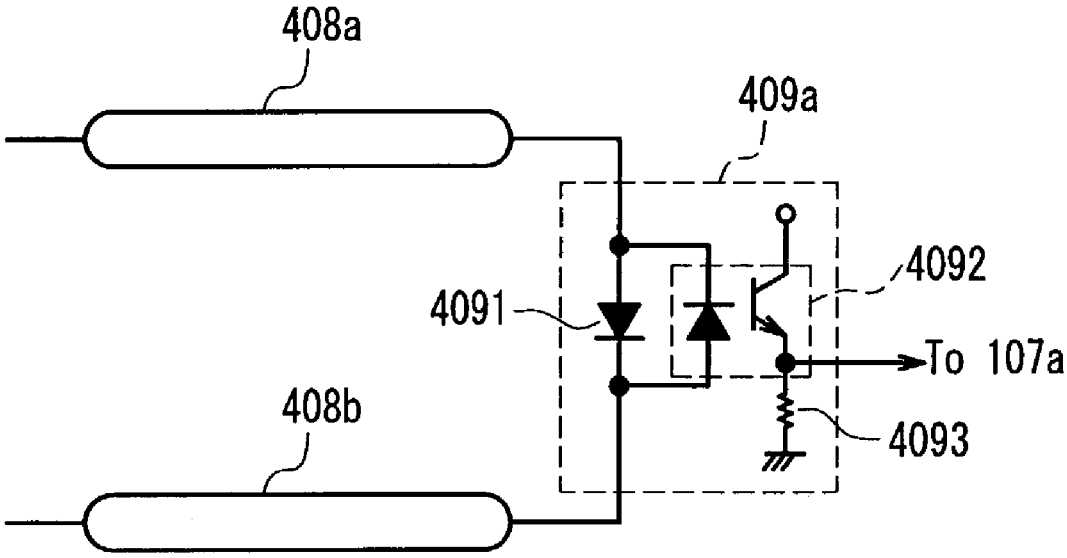
FIG. 20 is a circuit diagram showing an example of the internal configuration of the first current detecting portion 409*a* in FIG. 19.

FIG. 20 is a circuit diagram showing an example of the internal configuration of the first current detecting portion 409*a*. The internal configuration of the second current detecting portion 409*b* is the same as that of the first current detecting portion 409*a*. In FIG. 20, the first current detecting portion 409*a* includes a diode 4091, an optical isolator (photocoupler) 4092 and a resistive element 4093.

The diode 4091 and the optical isolator 4092 of the first current detecting portion 409*a* are connected between the cold cathode fluorescent tubes 408*a* and 408*b*. The diode 4091 is connected in parallel to a light emitting diode included in the optical isolator 4092 on the input side in such an orientation that the currents flow in the opposite directions. The light having an intensity corresponding to the current flowing the light emitting diode included in the optical isolator 4092 is received by a phototransistor, and the current that is photoelectrically exchanged by the phototransistor is converted to a voltage as a detection signal by the resistive element 4093. This detection signal is supplied to the first feedback portion 107*a*.

As described above, according to this embodiment, in order to turn on the first cold cathode fluorescent tube group including a plurality of cold cathode fluorescent tubes 408*a* and 408*b* and the second cold cathode fluorescent tube group including a plurality of cold cathode fluorescent tubes 408*c* and 408*d*, balanced output is performed by the plurality of piezoelectric transformers 410*a* and 410*b*. Thus, the two cold cathode fluorescent tubes can be turned on with one piezoelectric transformer, and power control can be performed with respect to each of the two cold cathode fluorescent tubes. As a result, the following advantages are provided.

1) Since all the cold cathode fluorescent tubes are driven at the same frequency, beat signals, which are difference frequencies generated when they are driven at close but different frequencies, are not generated. In addition, even if the impedance of each cold cathode fluorescent tube is different, this embodiment is equivalent to driving one tube, and therefore flickers in the cold cathode fluorescent tube during the steady operation or brightness differences between the plurality of cold cathode fluorescent tubes can be reduced.

2) Since the two cold cathode fluorescent tubes connected to the pair of secondary electrodes of one piezoelectric transformer are floated by the current detecting portion, a DC bias is not applied to the cold cathode fluorescent tube, unlike the structure of the piezoelectric transformer with one output on the secondary side in which two cold cathode fluorescent tubes and a current detecting resistor are connected in series between the secondary electrode and the ground potential. Therefore, lifetime shortening due to mercury movement can be prevented. In addition, this embodiment is equivalent to driving one tube, so that this embodiment is advantageous in safety design with respect to insulation (creeping distance, space distance or the like) of the inverter circuit.

3) The number of the inverter circuits can be reduced, leading to compactness and low cost.

In this embodiment as well as other embodiments, only one of the cold cathode fluorescent tube groups can be turned off.

It is possible to control the brightness of the first and the second cold cathode fluorescent tube groups individually by setting the first reference voltage Vref1 and the second reference voltage Vref2 to be different values from each other.

In this embodiment, the piezoelectric transformer having the conventional structure as shown in FIG. 18 is used. However, the same effect can be obtained with an other structure, as long as the voltage input from the primary side can be stepped up or down by the piezoelectric effect and can be output as voltages having 180 degree different phase from the secondary side.

The configuration of the fourth embodiment is applied to this embodiment, and the applied embodiment can be applied to the liquid crystal monitor of the sixth embodiment. Alternatively, this embodiment can be applied to the liquid crystal monitor of the fifth embodiment.

As described above, according to the present invention, it is possible to drive a plurality of piezoelectric transformers with a full-bridge circuit. As a result, the following events due to variations between individual piezoelectric transformers or the characteristics variation between the cold cathode fluorescent tubes can be eliminated: the driving frequencies at which the voltage step-up ratio is at the maximum value are varied, or the cold cathode fluorescent tubes are turned on at different timings. Thus, an efficient operation at a frequency near the resonant frequency can be performed, and further the operation can be stable.

Furthermore, it is possible to control a plurality of piezoelectric transformers individually, and thus a practical effect in a large-scaled liquid crystal system such as a liquid crystal monitor and a liquid crystal television employing a plurality of cold cathode fluorescent tubes is significantly large.

Furthermore, driving control can be performed in a digital manner by constructing a digital circuit portion excluding the portion that can be configured only by analog circuits as an integrated circuit, so that a more compact piezoelectric inverter circuit can be realized.

Furthermore, a plurality of cold cathode fluorescent tubes can be turned on with one piezoelectric transformer in the same manner as when driving one tube. In this case, the brightness difference during the steady operation can be reduced, and lifetime shortening can be prevented because a high voltage is not applied. In addition, this embodiment is equivalent to driving one tube, so that this embodiment is advantageous in safety design with respect to insulation of the inverter circuit. Moreover, even if the number of the cold cathode fluorescent tubes is increased, the number of the inverter circuits is unchanged, so that further compactness and low cost can be achieved.

Thus, according to the present invention, a highly reliable and compact piezoelectric inverter circuit can be realized, and its practical effect is significantly large.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A light emission control device comprising:

a plurality of serially-connected elements in each of which two switching portions are connected in series between a power potential and a ground potential, comprising:

a first serially-connected element, and a plurality of second serially-connected elements, each of which includes an inductor and a pair of input electrodes of a piezoelectric transformer, and is connected between a connection point of the switching portions of the first serially-connected element and a connection point of the switching portions of another serially-connected element; and a plurality of cold cathode fluorescent tubcs, each of which is connected to an output electrode of the piezoelectric transformer at one end.

2. The light emission control device according to claim 1, wherein driving frequencies of a plurality of piezoelectric transformers are set to a frequency higher than a highest resonant frequency of the plurality of piezoelectric transformers.

3. The light emission control device, according to claim 1, wherein the plurality of cold cathode fluorescent tubes are controlled individually with respect to brightness.

4. The light emission control device according to claim 3, wherein the brightness is controlled by turning on or off the plurality of cold cathode fluorescent tubes individually.

5. A light emission control device comprising:

a first serially-connected element connected between a power potential and a ground potential, including a first switching portion and a second switching portion that are turned on/off alternately in response to a first driving control signal and a second driving control signal, respectively;

a second serially-connected element connected in parallel to the first serially-connected element, including a third switching portion and a fourth switching portion that are turned on/off alternately in response to a third driving control signal and a fourth driving control signal, respectively, the third and the fourth driving control signals having the same frequency and duty ratio as those of the first and the second driving control signals;

a third serially-connected element connected in parallel to the first serially-connected element, including a fifth switching portion and a sixth switching portion that are turned on/off alternately in response to a fifth driving control signal and a sixth driving control signal, respectively, the fifth and the sixth driving control signals having the same frequency and duty ratio as those of the first and the second driving control signals;

a first and a second piezoelectric transformer that step up or down first and second voltaaes, respectively, input from respective primary electrodes by a piezoelectric effect and output the first and second voltages from first and second secondary electrodes respectively;

a fourth serially-connected element connected between a connection point of the first switching portion and the second switching portion and a connection point of the third switching portion and the fourth switching portion, including a first inductor and a pair of primary electrodes of the first piezoelectric transformer;

a fifth serially-connected element connected between a connection point of the first switching portion and the second switching portion and a connection point of the fifth switching portion and the sixth switching portion, including a second inductor and a pair of primary electrodes of the second pi ezoel ectric transformer;

a sixth serially-connected element connected between the first secondary electrode of the first piezoclectric transfonner and a ground potential, including a first cold cathode fluorescent tube and a first current detection resistor;

a seventh serially-connected element connected between the second secondary electrode of the second piezoelectric transformer and a ground potential, including a second cold cathode fluorescent tube and a second current detection resistor;

a first driving portion that generates the first and the second driving control signals;

a second driving portion that generates the third and the fourth driving control signals;

a third driving portion that generates the fifth and the sixth driving control signals;

a first feedback portion that rectifles an alternating voltage detected by the first current detection resistor and feeds back the voltage as a first detected voltage;

a second feedback portion that rectifies an alternating voltage detected by the second current detection resistor and feeds back the voltage as a second detected voltage;

a first comparing portion that compares the first detected voltage output from the first feedback portion with a first reference voltage and outputs a first error signal;

a second comparing portion that compares the second detected voltage output from the second feedback portion with a second reference voltage and outputs a second error signal;

a first phase control portion that outputs a signal for changing a phase of the third and the fourth driving control signals with respect to a phase of the first and the second driving control signals in accordance with the first error signal to the second driving portion; and a second phase control portion that outputs a signal for changing a phase of the fifth and the sixth driving control signals with respect to a phase of the first and the second driving control signals in accordance with the second error signal to the third driving portion.

6. The light emission control device according to claim 5, wherein driving frequencies of a plurality of piezoelectric transformers are set to a frequency higher than a highest resonant frequency of the plurality of piezoelectric transformers.

7. The light emission control device according to claim 5, wherein the plurality of cold cathode fluorescent tubes are controlled individually with respect to brightness.

8. The light emission control device according to claim 7, wherein the brightness is controlled by turning on or off the plurality of cold cathode fluorescent tubes individually.

9. A light emission control device comprising:

a first serially-connected element connected between a power potential and a ground potential, including a first switching portion and a second switching portion that are turned on/off alternately in response to a first driving control signal and a second driving control signal, respectively;

a second serially-connected element connected in parallel to the first serially-connected element, including a third switching portion and a fourth switching portion that are turned on/off alternately in response to a third driving control signal and a fourth driving control signal, respectively, the third and the fourth driving control signals having the same frequency and duty ratio as those of the first and the second driving control signals;

a third serially-connected element connected in parallel to the first serially-connected element, including a fifth switching portion and a sixth switching portion that are turned on/off alternately in response to a fifth driving control signal and a sixth driving control signal, respectively, the fifth and the sixth driving control signals having the same frequency and duty ratio as those of the first and the second driving control signals;

a first and a second piezoelectric transformer that step up or down first and second voltages, respectively, input from respective primary electrodes by a piezoelectric effect and output the first and second voltages from first and second secondary electrodes respectively;

a fourth serially-connected element connected between a connection point of the first switching portion and the second switching portion and a connection point of the third switching portion and the fourth switching portion, including a first inductor and a pair of primary electrodes of the first piezoelectric transformer;

a fifth serially-connected element connected between a connection point of the first switching portion and the second switching portion and a connection point of the fifth switching portion and the sixth switching portion, including a second inductor and a pair of primary electrodes of the second piezoelectric transformer;

a sixth serially-connected element connected between the first secondary electrode of the first piezoelectric transformer and a ground potential, including a first cold cathode fluorescent tube and a first current detection resistor;

a seventh serially-connected element connected between the second secondary electrode of the second piezoelectric transformer and a ground potential, including a second cold cathode fluorescent tube and a second current detection resistor;

a first driving portion that generates the first and the second driving control signals;

a second driving portion that generates the third and the fourth driving control signals;

a third driving portion that generates the fifth and the sixth driving control signals;

a first feedback portion that rectifies an alternating voltage detected by the first current detection resistor and feeds back the voltage as a first detected voltage;

a second feedback portion that rectifies an alternating voltage detected by the second current detection resistor and feeds back the voltage as a second detected voltage;

an A/D convening portion that converts analog values of the first and the second detected voltages output from the first and the second feedback portions to digital values of first and second detection data;

a first comparing portion that compares the first detection data output from the A/D converting portion with first reference data and outputs first error data;

a second comparing portion that compares the second detection data output from the A/D converting portion with second reference data and outputs second error data;

a first phase control portion that generates first phase control data for changing a phase of the third and the fourth driving control signals with respect to a phase of the first and the second driving control signals in accordance with the first error data;

a second phase control portion that generates second phase control data for changing a phase of the fifth and the sixth driving control signals with respect to a phase of the first and the second driving control signals in accordance with the second error data; and a D/A converting portion that converts the first and the second phase control data to analog values and outputs the analog values to the second and the third driving portion, respectively.

10. The light emission control device according to claim 9, wherein the A/D converting portion, the first and the second comparing portions, the first and the second phase control portions and the D/A converting portion are included in a microcomputer.

11. The light emission control device according to claim 9, wherein driving frequencies of a plurality of piezoelectric transformers are set to a frequency higher than a highest resonant frequency of the plurality of piezoelectric transformers.

12. The light emission control device according to claim 9, wherein the plurality of cold cathode fluorescent tubes are controlled individually with respect to brightness.

13. The light emission control device according to claim 11, wherein the brightness is controlled by turning on or off the plurality of cold cathode fluorescent tubes individually.

14. A light emission control device comprising:

a first serially-connected element connected between a power potential and a ground potential, including a first switching portion and a second switching portion that are turned on/off alternately in response to a first driving control signal and a second driving control signal, respectively;

a second serially-connected element connected in parallel to the first serially-connected element, including a third switching portion and a fourth switching portion that are turned on/off alternately in response to a third driving control signal and a fourth driving control signal, respectively, the third and the fourth driving control signals having the same frequency and duty ratio as those of the first and the second driving control signals;

a third serially-connected element connected in parallel to the first serially-connected element, including a fifth switching portion and a sixth switching portion that are turned on/off alternately in response to a fifth driving control signal and a sixth driving control signal, respectively, the fifth and the sixth driving control signals having the same frequency and duty ratio as those of the first and the second driving control signals;

a first and a second piezoelectric transformer that step up or down first and second voltages, respectively, input from respective primary electrodes by a piezoelectric effect and output the first and second voltages having a 180 degree phase from each other from first and second pairs of secondary electrodes respectively;

a fourth serially-connected element connected between a connection point of the first switching portion and the second switching portion and a connection point of the third switching portion and the fourth switching portion, including a first inductor and a pair of primary electrodes of the first piezoelectric transformer;

a fifth serially-connected element connected between a connection point of the first switching portion and the second switching portion and a connection point of the fifth switching portion and the sixth switching portion, including a second inductor and a pair of primary electrodes of the second piezoelectric transformer;

a sixth serially-connected element connected between a first pair of secondary electrodes of the first piezoelectric transformer, including a first cold cathode fluorescent tube group including a plurality of cold cathode fluorescent tubes and a first current detecting portion disposed between the plurality of cold cathode fluorescent tubes constituting the first cold cathode fluorescent tube group;

a seventh serially-connected element connected between a second pair of secondary electrodes of the second piezoelectric transformer, including a second cold cathode fluorescent tube group including a plurality of cold cathode fluorescent tubes and a second current detecting portion disposed between the plurality of cold cathode fluorescent tubes constituting the second cold cathode fluorescent tube group;

a first driving portion that generates the first and the second driving control signals;

a second driving portion that generates the third and the fourth driving control signals;

a third driving portion that generates the fifth and the sixth driving control signals;

a first feedback portion that rectifies an alternating voltage detected by the first current detecting portion and feeds back the voltage as a first detected voltage;

a second feedback portion that rectifies an alternating voltage detected by the second current detecting portion and feeds back the voltage as a second detected voltage;

a first comparing portion that compares the first detected voltage output from the first feedback portion with a first reference voltage and outputs a first error signal;

a second comparing portion that compares the second detected voltage output from the second feedback portion with a second reference voltage and outputs a second error signal;

a first phase control portion that outputs a signal for changing a phase of the third and the fourth driving control signals with respect to a phase of the first and the second driving control signals in accordance with the first error signal to the second driving portion; and a second phase control portion that outputs a signal for changing a phase of the fifth and the sixth driving control signals with respect to a phase of the first and the second driving control signals in accordance with the second error signal to the third driving portion.

15. The light emission control device according to claim 14, wherein driving frequencies of a plurality of piezoelectric transformers are set to a frequency higher than a highest resonant frequency of the plurality of piezoelectric transformers.

16. The light emission control device according to claim 14, wherein the first cold cathode fluorescent tube group and the second cold cathode fluorescent tube group are controlled individually with respect to brightness.

17. The light emission control device according to claim 16, wherein the brightness is controlled by turning on or off the first cold cathode fluorescent tube group and the second cold cathode fluorescent tube group individually.

18. A backlight device configured such that an object to be illuminated is illuminated from its back by a light emission control device, the light emission control device comprising:

a plurality of serially-connected elements in each of which two switching portions are connected in series between a power potential and a ground potential, comprising:

a first serially-connected element, and a plurality of second serially-connected elements, each of which includes an inductor and a pair of input electrodes of a piezoelectric transformer, and is connected between a connection point of the switching portions of the first serially-connected element and a connection point of the switching portions of another serially-connected element; and a plurality of cold cathode fluorescent tubes, each of which is connected to an output electrode of the piezoelectric transformer at one end.

19. A backlight device configured such that an object to be illuminated is illuminated from its back by a light emission control device, the light emission control device comprising:

a first serially-connected element connected between a power potential and a ground potential, including a first switching portion and a second switching portion that are turned on/off alternately in response to a first driving control signal and a second driving control signal, respectively;

a second serially-connected element connected in parallel to the first serially-connected element, including a third switching portion and a fourth switching portion that are turned on/off alternately in response to a third driving control signal and a fourth driving control signal, respectively, the third and the fourth driving control signals having the same frequency and duty ratio as those of the first and the second driving control signals;

a third serially-connected element connected in parallel to the first serially-connected element, including a fifth switching portion and a sixth switching portion that are turned on/off alternately in response to a fifth driving control signal and a sixth driving control signal, respectively, the fifth and the sixth driving control signals having the same frequency and duty ratio as those of the first and the second driving control signals;

a first and a second piezoelectric transformer that step up or down first and second voltages, respectively, input from respective primary electrodes by a piezoelectric effect and output the first and second voltages from first and second secondary electrodes respectively;

a fourth serially-connected element connected between a connection point of the first switching portion and the second switching portion and a connection point of the third switching portion and the fourth switching portion, including a first inductor and a pair of primary electrodes of the first piezoelectric transformer;

a fifth serially-connected element connected between a connection point of the first switching portion and the second switching portion and a connection point of the fifth switching portion and the sixth switching portion, including a second inductor and a pair of primary electrodes of the second piezoelectric transformer;

a sixth serially-connected element connected between the first secondary electrode of the first piezoelectric transformer and a ground potential, including a first cold cathode fluorescent tube and a first current detection resistor;

a seventh serially-connected element connected between the second secondary electrode of the second piezoelectric transformer and a ground potential, including a second cold cathode fluorescent tube and a second current detection resistor;

a first driving portion that generates the first and the second driving control signals;

a second driving portion that generates the third and the fourth driving control signals;

a third driving portion that generates the fifth and the sixth driving control signals;

a first feedback portion that rectifies an alternating voltage detected by the first current detection resistor and feeds back the voltage as a first detected voltage;

a second feedback portion that rectifies an alternating voltage detected by the second current detection resistor and feeds back the voltage as a second detected voltage;

a first comparing portion that compares the first detected voltage output from the first feedback portion with a first reference voltage and outputs a first error signal;

a second comparing portion that compares the second detected voltage output from the second feedback portion with a second reference voltage and outputs a second error signal;

a first phase control portion that outputs a signal for changing a phase of the third and the fourth driving control signals with respect to a phase of the first and the second driving control signals in accordance with the first error signal to the second driving portion; and a second phase control portion that outputs a signal for changing a phase of the fifth and the sixth driving control signals with respect to a phase of the first and the second driving control signals in accordance with the second error signal to the third driving portion.

20. A backlight device configured such that an object to be illuminated is illuminated from its back by a light emission control device, the light emission control device comprising:

a first serially-connected element connected between a power potential and a ground potential, including a first switching portion and a second switching portion that are turned on/off alternately in response to a first driving control signal and a second driving control signal, respectively;

a second serially-connected element connected in parallel to the first serially-connected element, including a third switching portion and a fourth switching portion that are turned on/off alternately in response to a third driving control signal and a fourth driving control signal, respectively, the third and the fourth driving control signals having the same frequency and duty ratio as those of the first and the second driving control signals;

a third serially-connected element connected in parallel to the first serially-connected element, including a fifth switching portion and a sixth switching portion that are turned on/off alternately in response to a fifth driving control signal and a sixth driving control signal, respectively, the fifth and the sixth driving control signals having the same frequency and duty ratio as those of the first and the second driving control signals;

a first and a second piezoelectric transformer that step up or down first and second voltages, respectively, input from respective primary electrodes by a piezoelectric effect and output the first and second voltages from first and second secondary electrodes respectively;

a fourth serially-connected element connected between a connection point of the first switching portion and the second switching portion and a connection point of the third switching portion and the fourth switching portion, including a first inductor and a pair of primary electrodes of the first piezoelectric transformer;

a fifth serially-connected element connected between a connection point of the first switching portion and the second switching portion and a connection point of the fifth switching portion and the sixth switching portion, including a second inductor and a pair of primary electrodes of the second piezoelectric transformer;

a sixth serially-connected element connected between the first secondary electrode of the first piezoelectric transformer and a ground potential, including a first cold cathode fluorescent tube and a first current detection resistor;

a seventh serially-connected element connected between the second secondary electrode of the second piezoelectric transformer and a ground potential, including a second cold cathode fluorescent tube and a second current detection resistor;

a first driving portion that generates the first and the second driving control signals;

a second driving portion that generates the third and the fourth driving control signals;

a third driving portion that generates the fifth and the sixth driving control signals;

a first feedback portion that rectifies an alternating voltage detected by the first current detection resistor and feeds back the voltage as a first detected voltage;

a second feedback portion that rectifies an alternating voltage detected by the second current detection resistor and feeds back the voltage as a second detected voltage;

an A/D converting portion that converts analog values of the first and the second detected voltages output from the first and the second feedback portions to digital values of first and second detection data;

a first comparing portion that compares the first detection data output from the A/D converting portion with first reference data and outputs first error data;

a second comparing portion that compares the second detection data output from the A/D converting portion with second reference data and outputs second error data;

a first phase control portion that generates first phase control data for changing a phase of the third and the fourth driving control signals with respect to a phase of the first and the second driving control signals in accordance with the first error data;

a second phase control portion that generates second phase control data for changing a phase of the fifth and the sixth driving control signals with respect to a phase of the first and the second driving control signals in accordance with the second error data; and a D/A converting portion that converts the first and the second phase control data to analog values and outputs the analog values to the second and the third driving portion, respectively.

21. A backlight device configured such that an object to be illuminated is illuminated from its back by a light emission control device, the light emission control device comprising:

a first serially-connected element connected between a power potential and a ground potential, including a first switching portion and a second switching portion that are turned on/off alternately in response to a first driving control signal and a second driving control signal, respectively;

a second serially-connected element connected in parallel to the first serially-connected element, including a third switching portion and a fourth switching portion that are turned on/off alternately in response to a third driving control signal and a fourth driving control signal, respectively, the third and the fourth driving control signals having the same frequency and duty ratio as those of the first and the second driving control signals;

a third serially-connected element connected in parallel to the first serially-connected element, including a fifth switching portion and a sixth switching portion that are turned on/off alternately in response to a fifth driving control signal and a sixth driving control signal, respectively, the fifth and the sixth driving control signals having the same frequency and duty ratio as those of the first and the second driving control signals;

a first and a second piezoelectric transformer that step up or down first and second voltages, respectively, input from respective primary electrodes by a piezoelectric effect and output the first and second voltges having a 180 degree phase from each other from first and second pairs of secondary electrodes respectively;

a fourth serially-connected element connected between a connection point of the first switching portion and the second switching portion and a connection point of the third switching portion and the fourth switching portion, including a first inductor and a pair of primary electrodes of the first piezoelectric transformer;

a fifth serially-connected element connected between a connection point of the first switching portion and the second switching portion and a connection point of the fifth switching portion and the sixth switching portion, including a second inductor and a pair of primary electrodes of the second piezoelectric transformer;

a sixth serially-connected element connected between a first pair of secondary electrodes of the first piezoelectric transformer, including a first cold cathode fluorescent tube group including a plurality of cold cathode fluorescent tubes and a first current detecting portion disposed between the plurality of cold cathode fluorescent tubes constituting the first cold cathode fluorescent tube group;

a seventh serially-connected element connected between a second pair of secondary electrodes of the second piezoelectric transformer, including a second cold cathode fluorescent tube group including a plurality of cold cathode fluorescent tubes and a second current detecting portion disposed between the plurality of cold cathode fluorescent tubes constituting the second cold cathode fluorescent tube group;

a first driving portion that generates the first and the second driving control signals;

a second driving portion that generates the third and the fourth driving control signals;

a third driving portion that generates the fifth and the sixth driving control signals;

a first feedback portion that rectifies an alternating voltage detected by the first current detecting portion and feeds back the voltage as a first detected voltage;

a second feedback portion that rectifies an alternating voltage detected by the second current detecting portion and feeds back the voltage as a second detected voltage;

a first comparing portion that compares the first detected voltage output from the first feedback portion with a first reference voltage and outputs a first error signal;

a second comparing portion that compares the second detected voltage output from the second feedback portion with a second reference voltage and outputs a second error signal;

a first phase control portion that outputs a signal for changing a phase of the third and the fourth driving control signals with respect to a phase of the first and the second driving control signals in accordance with the first error signal to the second driving portion; and a second phase control portion that outputs a signal for changing a phase of the fifth and the sixth driving control signals with respect to a phase of the first and the second driving control signals in accordance with the second error signal to the third driving portion.

22. A liquid crystal display apparatus configured such that a liquid crystal panel is illuminated by a backlight device, the backlight device being configured such that an object to be illuminated is illuminated from its back by a light emission control device that controls brightness by turning on or off a plurality of cold cathode fluorescent tubes individually, the light emission control device comprising:

a plurality of serially-connected elements in each of which two switching portions are connected in series between a power potential and a ground potential, comprising:

a first serially-connected element, and a plurality of second serially-connected elements, each of which includes an inductor and a pair of input electrodes of a piezoelectric transformer, and is connected between a connection point of the switching portions of the first serially-connected element and a connection point of the switching portions of another serially-connected element; and a plurality of cold cathode fluorescent tubes, each of which is connected to an output electrode of the piezoelectric transformer at one end.

23. A liquid crystal display apparatus configured such that a liquid crystal panel is illuminated by a backlight device, the backlight device being configured such that an object to be illuminated is illuminated from its back by a light emission control device that controls brightness by turning on or off a plurality of cold cathode fluorescent tubes individually, the light emission control device comprising:

a first serially-connected element connected between a power potential and a ground potential, including a first switching portion and a second switching portion that are turned on/off alternately in response to a first driving control signal and a second driving control signal, respectively;

a second serially-connected element connected in parallel to the first serially-connected element, including a third switching portion and a fourth switching portion that are turned on/off alternately in response to a third driving control signal and a fourth driving control signal, respectively, the third and the fourth driving control signals having the same frequency and duty ratio as those of the first and the second driving control signals;

a third serially-connected element connected in parallel to the first serially-connected element, including a fifth switching portion and a sixth switching portion that are turned on/off alternately in response to a fifth driving control signal and a sixth driving control signal, respectively, the fifth and the sixth driving control signals having the same frequency and duty ratio as those of the first and the second driving control signals;

a first and a second piezoelectric transformer that step up or down first and second voltages, respectively, input from respective primary electrodes by a piezoelectric effect and output the first and second voltages from first and second secondary electrodes respectively;

a fourth serially-connected element connected between a connection point of the first switching portion and the second switching portion and a connection point of the third switching portion and the fourth switching portion, including a first inductor and a pair of primary electrodes of the first piezoelectric transformer;

a fifth serially-connected element connected between a connection point of the first switching portion and the second switching portion and a connection point of the fifth switching portion and the sixth switching portion, including a second inductor and a pair of primary electrodes of the second piezoelectric transformer;

a sixth serially-connected element connected between the first secondary electrode of the first piezoelectric transformer and a ground potential, including a first cold cathode fluorescent tube and a first current detection resistor;

a seventh serially-connected element connected between the second secondary electrode of the second piezoelectric transformer and a ground potential, including a second cold cathode fluorescent tube and a second current detection resistor;

a first driving portion that generates the first and the second driving control signals;

a second driving portion that generates the third and the fourth driving control signals;

a third driving portion that generates the fifth and the sixth driving control signals;

a first feedback portion that rectifies an alternating voltage detected by the first current detection resistor and feeds back the voltage as a first detected voltage;

a second feedback portion that rectifies an alternating voltage detected by the second current detection resistor and feeds back the voltage as a second detected voltage;

a first comparing portion that compares the first detected voltage output from the first feedback portion with a first reference voltage and outputs a first error signal;

a second comparing portion that compares the second detected voltage output from the second feedback portion with a second reference voltage and outputs a second error signal;

a first phase control portion that outputs a signal for changing a phase of the third and the fourth driving control signals with respect to a phase of the first and the second driving control signals in accordance with the first error signal to the second driving portion; and a second phase control portion that outputs a signal for changing a phase of the fifth and the sixth driving control signals with respect to a phase of the first and the second driving control signals in accordance with the second error signal to the third driving portion.

24. A liquid crystal display apparatus configured such that a liquid crystal panel is illuminated by a backlight device, the backlight device being configured such that an object to be illuminated is illuminated from its back by a light emission control device that controls brightness by turning on or off a plurality of cold cathode fluorescent tubes individually, the light emission control device comprising:

a first serially-connected element connected between a power potential and a ground potential, including a first switching portion and a second switching portion that are turned on/off alternately in response to a first driving control signal and a second driving control signal, respectively;

a second serially-connected element connected in parallel to the first serially-connected element, including a third switching portion and a fourth switching portion that are turned on/off alternately in response to a third driving control signal and a fourth driving control signal, respectively, the third and the fourth driving control signals having the same frequency and duty ratio as those of the first and the second driving control signals;

a third serially-connected element connected in parallel to the first serially-connected element, including a fifth switching portion and a sixth switching portion that are turned on/off alternately in response to a fifth driving control signal and a sixth driving control signal, respectively, the fifth and the sixth driving control signals having the same frequency and duty ratio as those of the first and the second driving control signals;

a first and a second piezoelectric transformer that step up or down first and second voltages, respectively, input from respective primary electrodes by a piezoelectric effect and output the first and second voltages from first and second secondary electrodes respectively;

a fourth serially-connected element connected between a connection point of the first switching portion and the second switching portion and a connection point of the third switching portion and the fourth switching portion, including a first inductor and a pair of primary electrodes of the first piezoelectric transformer;

a fifth serially-connected element connected between a connection point of the first switching portion and the second switching portion and a connection point of the third switching portion and the sixth switching portion, including a second inductor and a pair of primary electrodes of the second piezoelectric transformer;

a sixth serially-connected element connected between the first secondary electrode of the first piezoelectric transformer and a ground potential, including a first cold cathode fluorescent tube and a first current detection resistor;

a seventh serially-connected element connected between the second secondary electrode of the second piezoelectric transformer and a ground potential, including a second cold cathode fluorescent tube and a second current detection resistor;

a first driving portion that generates the first and the second driving control signals;

a second driving portion that generates the third and the fourth driving control signals;

a third driving portion that generates the fifth and the sixth driving control signals;

a first feedback portion that rectifies an alternating voltage detected by the first current detection resistor and feeds back the voltage as a first detected voltage;

a second feedback portion that rectifies an alternating voltage detected by the second current detection resistor and feeds back the voltage as a second detected voltage;

an A/D converting portion that converts analog values of the first and the second detected voltages output from the first and the second feedback portions to digital values of first and second detection data;

a first comparing portion that compares the first detection data output from the A/D converting portion with first reference data and outputs first error data;

a second comparing portion that compares the second detection data output from the A/D converting portion with second reference data and outputs second error data;

a first phase control portion that generates first phase control data for changing a phase of the third and the fourth driving control signals with respect to a phase of the first and the second driving control signals in accordance with the first error data;

a second phase control portion that generates second phase control data for changing a phase of the fifth and the sixth driving control signals with respect to a phase of the first and the second driving control signals in accordance with the second error data; and a D/A converting portion that converts the first and the second phase control data to analog values and outputs the analog values to the second and the third driving portion, respectively.

25. A liquid crystal display apparatus configured such that a liquid crystal panel is illuminated by a backlight device, the backlight device being configured such that an object to be illuminated is illuminated from its back by a light emission control device that controls brightness by turning on or off a plurality of cold cathode fluorescent tubes individually, the light emission control device comprising:

a first serially-connected element connected between a power potential and a ground potential, including a first switching portion and a second switching portion that are turned on/off alternately in response to a first driving control signal and a second driving control signal, respectively;

a second serially-connected element connected in parallel to the first serially-connected element, including a third switching portion and a fourth switching portion that are turned on/off alternately in response to a third driving control signal and a fourth driving control signal, respectively, the third and the fourth driving control signals having the same frequency and duty ratio as those of the first and the second driving control signals;

a third serially-connected element connected in parallel to the first serially-connected element, including a fifth switching portion and a sixth switching portion that are turned on/off alternately in response to a fifth driving control signal and a sixth driving control signal, respectively, the fifth and the sixth driving control signals having the same frequency and duty ratio as those of the first and the second driving control signals;

a first and a second piezoelectric transformer that step up or down first and second voltages, respectively, input from respective primary electrodes by a piezoelectric effect and output the first and second voltages having a 180 degree phase from each other from first and second pairs of secondary electrodes respectively;

a fourth serially-connected element connected between a connection point of the first switching portion and the second switching portion and a connection point of the third switching portion and the fourth switching portion, including a first inductor and a pair of primary electrodes of the first piezoelectric transformer;

a fifth serially-connected element connected between a connection point of the first switching portion and the second switching portion and a connection point of the fifth switching portion and the sixth switching portion, including a second inductor and a pair of primary electrodes of the second piezoelectric transformer;

a sixth serially-connected element connected between a first pair of secondary electrodes of the first piezoelectric transformer, including a first cold cathode fluorescent tube group including a plurality of cold cathode fluorescent tubes and a first current detecting portion disposed between the plurality of cold cathode fluorescent tubes constituting the first cold cathode fluorescent tube group;

a seventh serially-connected element connected between a second pair of secondary electrodes of the second piezoelectric transformer, including a second cold cathode fluorescent tube group including a plurality of cold cathode fluorescent tubes and a second current detecting portion disposed between the plurality of cold cathode fluorescent tubes constituting the second cold cathode fluorescent tube group;

a first driving portion that generates the first and the second driving control signals;

a second driving portion that generates the third and the fourth driving control signals;

a third driving portion that generates the fifth and the sixth driving control signals;

a first feedback portion that rectifies an alternating voltage detected by the first current detecting portion and feeds back the voltage as a first detected voltage;

a second feedback portion that rectifies an alternating voltage detected by the second current detecting portion and feeds back the voltage as a second detected voltage;

a first comparing portion that compares the first detected voltage output from the first feedback portion with a first reference voltage and outputs a first error signal;

a second comparing portion that compares the second detected voltage output from the second feedback portion with a second reference voltage and outputs a second error signal;

a first phase control portion that outputs a signal for changing a phase of the third and the fourth driving control signals with respect to a phase of the first and the second driving control signals in accordance with the first error signal to the second driving portion; and a second phase control portion that outputs a signal for changing a phase of the fifth and the sixth driving control signals with respect to a phase of the first and the second driving control signals in accordance with the second error signal to the third driving portion.

26. A liquid crystal monitor employing a liquid crystal display apparatus configured such that a liquid crystal panel is illuminated by a backlight device, the backlight device being configured such that an object to be illuminated is illuminated from its back by a light emission control device that controls brightness by turning on or off a plurality of cold cathode fluorescent tubes individually, the light emission control device comprising:

a plurality of serially-connected elements in each of which two switching portions are connected in series between a power potential and a ground potential, comprising:

a first serially-connected element, and a plurality of second serially-connected elements, each of which includes an inductor and a pair of input electrodes of a piezoelectric transformer, and is connected between a connection point of the switching portions of the first serially-connected element and a connection point of the switching portions of another serially-connected element; and a plurality of cold cathode fluorescent tubes, each of which is connected to an output electrode of the piezoelectric transformer at one end.

27. A liquid crystal monitor employing a liquid crystal display apparatus configured such that a liquid crystal panel is illuminated by a backlight device, the backlight device being configured such that an object to be illuminated is illuminated from its back by a light emission control device that controls brightness by turning on or off a plurality of cold cathode fluorescent tubes individually, the light emission control device comprising:

a first serially-connected element connected between a power potential and a ground potential, including a first switching portion and a second switching portion that are turned on/off alternately in response to a first driving control signal and a second driving control signal, respectively;

a second serially-connected element connected in parallel to the first serially-connected element, including a third switching portion and a fourth switching portion that are turned on/off alternately in response to a third driving control signal and a fourth driving control signal, respectively, the third and the fourth driving control signals having the same frequency and duty ratio as those of the first and the second driving control signals;

a third serially-connected element connected in parallel to the first serially-connected element, including a fifth switching portion and a sixth switching portion that are turned on/off alternately in response to a fifth driving control signal and a sixth driving control signal, respectively, the fifth and the sixth driving control signals having the same frequency and duty ratio as those of the first and the second driving control signals;

a first and a second piezoelectric transformer that step up or down first and second voltages, respectively, input from respective primary electrodes by a piezoelectric effect and output the first and second voltages from first and second secondary electrodes respectively;

a fourth serially-connected element connected between a connection point of the first switching portion and the second switching portion and a connection point of the third switching portion and the fourth switching portion, including a first inductor and a pair of primary electrodes of the first piezoelectric transformer;

a fifth serially-connected element connected between a connection point of the first switching portion and the second switching portion and a connection point of the fifth switching portion and the sixth switching portion, including a second inductor and a pair of primary electrodes of the second piezoelectric transformer;

a sixth serially-connected element connected between the first secondary electrode of the first piezoelectric transformer and a ground potential, including a first cold cathode fluorescent tube and a first current detection resistor;

a seventh serially-connected element connected between the second secondary electrode of the second piezoelectric transformer and a ground potential, including a second cold cathode fluorescent tube and a second current detection resistor;

a first driving portion that generates the first and the second driving control signals;

a second driving portion that generates the third and the fourth driving control signals;

a third driving portion that generates the fifth and the sixth driving control signals;

a first feedback portion that rectifies an alternating voltage detected by the first current detection resistor and feeds back the voltage as a first detected voltage;

a second feedback portion that rectifies an alternating voltage detected by the second current detection resistor and feeds back the voltage as a second detected voltage;

a first comparing portion that compares the first detected voltage output from the first feedback portion with a first reference voltage and outputs a first error signal;

a second comparing portion that compares the second detected voltage output from the second feedback portion with a second reference voltage and outputs a second error signal;

a first phase control portion that outputs a signal for changing a phase of the third and the fourth driving control signals with respect to a phase of the first and the second driving control signals in accordance with the first error signal to the second driving portion; and a second phase control portion that outputs a signal for changing a phase of the fifth and the sixth driving control signals with respect to a phase of the first and the second driving control signals in accordance with the second error signal to the third driving portion.

28. A liquid crystal monitor employing a liquid crystal display apparatus configured such that a liquid crystal panel is illuminated by a backlight device, the backlight device being configured such that an object to be illuminated is illuminated from its back by a light emission control device that controls brightness by turning on or off a plurality of cold cathode fluorescent tubes individually, the light emission control device comprising:

a first serially-connected element connected between a power potential and a ground potential, including a first switching portion and a second switching portion that are turned on/off alternately in response to a first driving control signal and a second driving control signal, respectively;

a second serially-connected element connected in parallel to the first serially-connected element, including a third switching portion and a fourth switching portion that are turned on/off alternately in response to a third driving control signal and a fourth driving control signal, respectively, the third and the fourth driving control signals having the same frequency and duty ratio as those of the first and the second driving control signals;

a third serially-connected element connected in parallel to the first serially-connected element, including a fifth switching portion and a sixth switching portion that are turned on/off alternately in response to a fifth driving control signal and a sixth driving control signal, respectively, the fifth and the sixth driving control signals having the same frequency and duty ratio as those of the first and the second driving control signals;

a first and a second piezoelectric transformer that step up or down first and second voltages, respectively, input from respective primary electrodes by a piezoelectric effect and output the first and second voltages from first and second secondary electrodes respectively;

a fourth serially-connected element connected between a connection point of the first switching portion and the second switching portion and a connection point of the third switching portion and the fourth switching portion, including a first inductor and a pair of primary electrodes of the first piezoelectric transformer;

a fifth serially-connected element connected between a connection point of the first switching portion and the second switching portion and a connection point of the fifth switching portion and the sixth switching portion, including a second inductor and a pair of primary electrodes of the second piezoelectric transformer;

a sixth serially-connected element connected between the first secondary electrode of the first piezoelectric transformer and a ground potential, including a first cold cathode fluorescent tube and a first current detection resistor;

a seventh serially-connected element connected between the second secondary electrode of the second piezoelectric transformer and a ground potential, including a second cold cathode fluorescent tube and a second current detection resistor;

a first driving portion that generates the first and the second driving control signals;

a second driving portion that generates the third and the fourth driving control signals;

a third driving portion that generates the fifth and the sixth driving control signals;

a first feedback portion that rectifies an alternating voltage detected by the first current detection resistor and feeds back the voltage as a first detected voltage;

a second feedback portion that rectifies an alternating voltage detected by the second current detection resistor and feeds back the voltage as a second detected voltage;

an A/D converting portion that converts analog values of the first and the second detected voltages output from the first and the second feedback portions to digital values of first and second detection data;

a first comparing portion that compares the first detection data output from the A/D converting portion with first reference data and outputs first error data;

a second comparing portion that compares the second detection data output from the A/D converting portion with second reference data and outputs second error data;

a first phase control portion that generates first phase control data for changing a phase of the third and the fourth driving control signals with respect to a phase of the first and the second driving control signals in accordance with the first error data;

a second phase control portion that generates second phase control data for changing a phase of the fifth and the sixth driving control signals with respect to a phase of the first and the second driving control signals in accordance with the second error data; and a D/A converting portion that converts the first and the second phase control data to analog values and outputs the analog values to the second and the third driving portion, respectively.

29. A liquid crystal monitor employing a liquid crystal display apparatus configured such that a liquid crystal panel is illuminated by a backlight device, the backlight device being configured such that an object to be illuminated is illuminated from its back by a light emission control device that controls brightness by turning on or off a plurality of cold cathode fluorescent tubes individually, the light emission control device comprising:

a first serially-connected element connected between a power potential and a ground potential, including a first switching portion and a second switching portion that are turned on/off alternately in response to a first driving control signal and a second driving control signal, respectively;

a second serially-connected element connected in parallel to the first serially-connected element, including a third switching portion and a fourth switching portion that are turned on/off alternately in response to a third driving control signal and a fourth driving control signal, respectively, the third and the fourth driving control signals having the same frequency and duty ratio as those of the first and the second driving control signals;

a third serially-connected element connected in parallel to the first serially-connected element, including a fifth switching portion and a sixth switching portion that are turned on/off alternately in response to a fifth driving control signal and a sixth driving control signal, respectively, the fifth and the sixth driving control signals having the same frequency and duty ratio as those of the first and the second driving control signals;

a first and a second piezoelectric transformer that step up or down first and second voltages, respectively, input from respective primary electrodes by a piezoelectric effect and output the first and second voltages having a 180 degree phase from each other from first and second pairs of secondary electrodes respectively;

a fourth serially-connected element connected between a connection point of the first switching portion and the second switching portion and a connection point of the third switching portion and the fourth switching portion, including a first inductor and a pair of primary electrodes of the first piezoelectric transformer;

a fifth serially-connected element connected between a connection point of the first switching portion and the second switching portion and a connection point of the fifth switching portion and the sixth switching portion, including a second inductor and a pair of primary electrodes of the second piezoelectric transformer;

a sixth serially-connected element connected between a first pair of secondary electrodes of the first piezoelectric transformer, including a first cold cathode fluorescent tube group including a plurality of cold cathode fluorescent tubes and a first current detecting portion disposed between the plurality of cold cathode fluorescent tubes constituting the first cold cathode fluorescent tube group;

a seventh serially-connected element connected between a second pair of secondary electrodes of the second piezoelectric transformer, including a second cold cathode fluorescent tube group including a plurality of cold cathode fluorescent tubes and a second current detecting portion disposed between the plurality of cold cathode fluorescent tubes constituting the second cold cathode fluorescent tube group;

a first driving portion that generates the first and the second driving control signals;

a second driving portion that generates the third and the fourth driving control signals;

a third driving portion that generates the fifth and the sixth driving control signals;

a first feedback portion that rectifies an alternating voltage detected by the first current detecting portion and feeds back the voltage as a first detected voltage;

a second feedback portion that rectifies an alternating voltage detected by the second current detecting portion and feeds back the voltage as a second detected voltage;

a first comparing portion that compares the first detected voltage output from the first feedback portion with a first reference voltage and outputs a first error signal;

a second comparing portion that compares the second detected voltage output from the second feedback portion with a second reference voltage and outputs a second error signal;

a first phase control portion that outputs a signal for changing a phase of the third and the fourth driving control signals with respect to a phase of the first and the second driving control signals in accordance with the first error signal to the second driving portion; and a second phase control portion that outputs a signal for changing a phase of the fifth and the sixth driving control signals with respect to a phase of the first and the second driving control signals in accordance with the second error signal to the third driving portion.

30. A liquid crystal television employing a liquid crystal display apparatus configured such that a liquid crystal panel is illuminated by a backlight device, the backlight device being configured such that an object to be illuminated is illuminated from its back by a light emission control device that controls brightness by turning on or off a plurality of cold cathode fluorescent tubes individually, the light emission control device comprising:

a plurality of serially-connected elements in each of which two switching portions are connected in series between a power potential and a ground potential, comprising:

a first serially-connected element, and a plurality of second serially-connected elements, each of which includes an inductor and a pair of input electrodes of a piezoelectric transformer, and is connected between a connection point of the switching portions of the first serially-connected element and a connection point of the switching portions of another serially-connected element; and a plurality of cold cathode fluorescent tubes, each of which is connected to an output electrode of the piezoelectric transformer at one end.

31. A liquid crystal television employing a liquid crystal display apparatus configured such that a liquid crystal panel is illuminated by a backlight device, the backlight device being configured such that an object to be illuminated is illuminated from its back by a light emission control device that controls brightness by turning on or off a plurality of cold cathode fluorescent tubes individually, the light emission control device comprising:

a first serially-connected element connected between a power potential and a ground potential, including a first switching portion and a second switching portion that are turned on/off alternately in response to a first driving control signal and a second driving control signal, respectively;

a second serially-connected element connected in parallel to the first serially-connected element, including a third switching portion and a fourth switching portion that are turned on/off alternately in response to a third driving control signal and a fourth driving control signal, respectively, the third and the fourth driving control signals having the same frequency and duty ratio as those of the first and the second driving control signals;

a third serially-connected element connected in parallel to the first serially-connected element, including a fifth switching portion and a sixth switching portion that are turned on/off alternately in response to a fifth driving control signal and a sixth driving control signal, respectively, the fifth and the sixth driving control signals having the same frequency and duty ratio as those of the first and the second driving control signals;

a first and a second piezoelectric transformer that step up or down first and second voltages, respectively, input from respective primary electrodes by a piezoelectric effect and output the first and second voltages from first and second secondary electrodes respectively;

a fourth serially-connected element connected between a connection point of the first switching portion and the second switching portion and a connection point of the third switching portion and the fourth switching portion, including a first inductor and a pair of primary electrodes of the first piezoelectric transformer;

a fifth serially-connected element connected between a connection point of the first switching portion and the second switching portion and a connection point of the fifth switching portion and the sixth switching portion, including a second inductor and a pair of primary electrodes of the second piezoelectric transformer;

a sixth serially-connected element connected between the first secondary electrode of the first piezoelectric transformer and a ground potential, including a first cold cathode fluorescent tube and a first current detection resistor;

a seventh serially-connected element connected between the second secondary electrode of the second piezoelectric transformer and a ground potential, including a second cold cathode fluorescent tube and a second current detection resistor;

a first driving portion that generates the first and the second driving control signals;

a second driving portion that generates the third and the fourth driving control signals;

a third driving portion that generates the fifth and the sixth driving control signals;

a first feedback portion that rectifies an alternating voltage detected by the first current detection resistor and feeds back the voltage as a first detected voltage;

a second feedback portion that rectifies an alternating voltage detected by the second current detection resistor and feeds back the voltage as a second detected voltage;

a first comparing portion that compares the first detected voltage output from the first feedback portion with a first reference voltage and outputs a first error signal;

a second comparing portion that compares the second detected voltage output from the second feedback portion with a second reference voltage and outputs a second error signal;

a first phase control portion that outputs a signal for changing a phase of the third and the fourth driving control signals with respect to a phase of the first and the second driving control signals in accordance with the first error signal to the second driving portion; and a second phase control portion that outputs a signal for changing a phase of the fifth and the sixth driving control signals with respect to a phase of the first and the second driving control signals in accordance with the second error signal to the third driving portion.

32. A liquid crystal television employing a liquid crystal display apparatus configured such that a liquid crystal panel is illuminated by a backlight device, the backlight device being configured such that an object to be illuminated is illuminated from its back by a light emission control device that controls brightness by turning on or off a plurality of cold cathode fluorescent tubes individually, the light emission control device comprising:

a first serially-connected element connected between a power potential and a ground potential, including a first switching portion and a second switching portion that are turned on/off alternately in response to a first driving control signal and a second driving control signal, respectively;

a second serially-connected element connected in parallel to the first serially-connected element, including a third switching portion and a fourth switching portion that are turned on/off alternately in response to a third driving control signal and a fourth driving control signal, respectively, the third and the fourth driving control signals having the same frequency and duty ratio as those of the first and the second driving control signals;

a third serially-connected element connected in parallel to the first serially-connected element, including a fifth switching portion and a sixth switching portion that are turned on/off alternately in response to a fifth driving control signal and a sixth driving control signal, respectively, the fifth and the sixth driving control signals having the same frequency and duty ratio as those of the first and the second driving control signals;

a first and a second piezoelectric transformer that step up or down first and second voltages, respectively, input from respective primary electrodes by a piezoelectric effect and output the first and second voltages from first and second secondary electrodes respectively;

a fourth serially-connected element connected between a connection point of the first switching portion and the second switching portion and a connection point of the third switching portion and the fourth switching portion, including a first inductor and a pair of primary electrodes of the first piezoelectric transformer;

a fifth serially-connected element connected between a connection point of the first switching portion and the second switching portion and a connection point of the fifth switching portion and the sixth switching portion, including a second inductor and a pair of primary electrodes of the second piezoelectric transformer;

a sixth serially-connected element connected between the first secondary electrode of the first piezoelectric transformer and a ground potential, including a first cold cathode fluorescent tube and a first current detection resistor;

a seventh serially-connected element connected between the second secondary electrode of the second piezoelectric transformer and a ground potential, including a second cold cathode fluorescent tube and a second current detection resistor;

a first driving portion that generates the first and the second driving control signals;

a second driving portion that generates the third and the fourth driving control signals;

a third driving portion that generates the fifth and the sixth driving control signals;

a first feedback portion that rectifies an alternating voltage detected by the first current detection resistor and feeds back the voltage as a first detected voltage;

a second feedback portion that rectifies an alternating voltage detected by the second current detection resistor and feeds back the voltage as a second detected voltage;

an A/D converting portion that converts analog values of the first and the second detected voltages output from the first and the second feedback portions to digital values of first and second detection data;

a first comparing portion that compares the first detection data output from the A/D converting portion with first reference data and outputs first error data;

a second comparing portion that compares the second detection data output from the A/D converting portion with second reference data and outputs second error data;

a first phase control portion that generates first phase control data for changing a phase of the third and the fourth driving control signals with respect to a phase of the first and the second driving control signals in accordance with the first error data;

a second phase control portion that generates second phase control data for changing a phase of the fifth and the sixth driving control signals with respect to a phase of the first and the second driving control signals in accordance with the second error data; and a D/A converting portion that converts the first and the second phase control data to analog values and outputs the analog values to the second and the third driving portion, respectively.

33. A liquid crystal television employing a liquid crystal display apparatus configured such that a liquid crystal panel is illuminated by a backlight device, the backlight device being configured such that an object to be illuminated is illuminated from its back by a light emission control device that controls brightness by turning on or off a plurality of cold cathode fluorescent tubes individually, the light emission control device comprising:

a first serially-connected element connected between a power potential and a ground potential, including a first switching portion and a second switching portion that are turned on/off alternately in response to a first driving control signal and a second driving control signal, respectively;

a second serially-connected element connected in parallel to the first serially-connected element, including a third switching portion and a fourth switching portion that are turned on/off alternately in response to a third driving control signal and a fourth driving control signal, respectively, the third and the fourth driving control signals having the same frequency and duty ratio as those of the first and the second driving control signals;

a third serially-connected element connected in parallel to the first serially-connected element, including a fifth switching portion and a sixth switching portion that are turned on/off alternately in response to a fifth driving control signal and a sixth driving control signal, respectively, the fifth and the sixth driving control signals having the same frequency and duty ratio as those of the first and the second driving control signals;

a first and a second piezoelectric transformer that step up or down first and second voltages, respectively, input from respective primary electrodes by a piezoelectric effect and output the first and second voltages having a 180 degree phase from each other from first and second pairs of secondary electrodes respectively;

a fourth serially-connected element connected between a connection point of the first switching portion and the second switching portion and a connection point of the third switching portion and the fourth switching portion, including a first inductor and a pair of primary electrodes of the first piezoelectric transformer;

a fifth serially-connected element connected between a connection point of the first switching portion and the second switching portion and a connection point of the fifth switching portion and the sixth switching portion, including a second inductor and a pair of primary electrodes of the second piezoelectric transformer;

a sixth serially-connected element connected between a first pair of secondary electrodes of the first piezoelectric transformer, including a first cold cathode fluorescent tube group including a plurality of cold cathode fluorescent tubes and a first current detecting portion disposed between the plurality of cold cathode fluorescent tubes constituting the first cold cathode fluorescent tube group;

a seventh serially-connected element connected between a second pair of secondary electrodes of the second piezoelectric transformer, including a second cold cathode fluorescent tube group including a plurality of cold cathode fluorescent tubes and a second current detecting portion disposed between the plurality of cold cathode fluorescent tubes constituting the second cold cathode fluorescent tube group;

a first driving portion that generates the first and the second driving control signals;

a second driving portion that generates the third and the fourth driving control signals;

a third driving portion that generates the fifth and the sixth driving control signals;

a first feedback portion that rectifies an alternating voltage detected by the first current detecting portion and feeds back the voltage as a first detected voltage;

a second feedback portion that rectifies an alternating voltage detected by the second current detecting portion and feeds back the voltage as a second detected voltage;

a first comparing portion that compares the first detected voltage output from the first feedback portion with a first reference voltage and outputs a first error signal;

a second comparing portion that compares the second detected voltage output from the second feedback portion with a second reference voltage and outputs a second error signal;

a first phase control portion that outputs a signal for changing a phase of the third and the fourth driving control signals with respect to a phase of the first and the second driving control signals in accordance with the first error signal to the second driving portion; and a second phase control portion that outputs a signal for changing a phase of the fifth and the sixth driving control signals with respect to a phase of the first and the second driving control signals in accordance with the second error signal to the third driving portion.

* * * * *

UNITED STATES PATENT AND TRADEMARK OFFICE

CERTIFICATE OF CORRECTION

PATENT NO. : 7,012,578 B2
APPLICATION NO. : 10/454975
DATED : March 14, 2006
INVENTOR(S) : Nakatsuka et al.

It is certified that error appears in the above-identified patent and that said Letters Patent is hereby corrected as shown below:

Column 25, line 60(claim 5): “voltaaes” should read --voltages--
Column 26, line 10(claim 5): “piezoclectric” should read --piezoelectric--
Column 26, lines 10-11(claim 5): “transfonner” should read --transformer--
Column 26, line 25(claim 5): “rectifles” should read --rectifies--
Column 33, line 35(claim 21): “voltges” should read --voltages--
Column 34, line 5(claim 21): “rectifles” should read --rectifies--

Signed and Sealed this

Sixth Day of March, 2007

JON W. DUDAS
*Director of the United States Patent and Trademark Office*